United States Patent [19]

Ogawa

[11] Patent Number: 4,818,674

[45] Date of Patent: Apr. 4, 1989

[54] SILVER HALIDE EMULSIONS COMPRISING GRAINS WITH (100) SURFACES HAVING CONJUGATED (110) SURFACE CRYSTALS THEREON AND METHOD FOR THE PREPARATION THEREOF

[75] Inventor: Tadashi Ogawa, Kanagawa, Japan

[73] Assignee: Fuji Photo Film Co., Ltd., Kanagawa, Japan

[21] Appl. No.: 51,435

[22] Filed: May 19, 1987

[30] Foreign Application Priority Data

May 19, 1986 [JP] Japan ..... 61-114275

[51] Int. Cl.[4] ..... G03C 1/02

[52] U.S. Cl. ..... 430/567; 430/569; 430/570; 430/576; 430/581; 430/591

[58] Field of Search ..... 430/567, 569, 570, 576, 430/581, 591

[56] References Cited

U.S. PATENT DOCUMENTS

| | | | |
|---|---|---|---|
| 4,094,684 | 6/1978 | Maskasky | 430/567 |
| 4,463,087 | 7/1984 | Maskasky | 430/567 |
| 4,471,050 | 9/1984 | Maskasky | 430/567 |
| 4,495,277 | 1/1985 | Becker et al. | 430/569 |
| 4,496,652 | 1/1985 | Haugh et al. | 430/567 |
| 4,683,192 | 7/1987 | Nishiyama | 430/567 |
| 4,735,894 | 4/1988 | Ogawa | 430/567 |

FOREIGN PATENT DOCUMENTS 0171238 12/1986 European Pat. Off. .

OTHER PUBLICATIONS

Berry and Skillman, "Surface Structures and Epitaxial Growths on ASB2 Microcrystals" Journal of Applied Physics, 35, 7, 2165 (1964).

Berry, Photographic Science and Engineering, 19, 3, 29 (1975).

*Primary Examiner*—Mukund J. Shah

*Attorney, Agent, or Firm*—Sughrue, Mion, Zinn, Macpeak, and Seas

[57] ABSTRACT

The present invention provides a novel silver chlorobromide emulsion which is substantially free from silver iodide and which contains silver halide crystal particles comprising cubic, rectangular parallelepiped or tetradecanedral first silver halide crystals having six (100) surfaces which may further comprise additional (110) surfaces, at least one of the six (100) surfaces being conjugated with second silver halide crystals having a halogen composition different from that of the (100) surfaces of the first silver halide crystals and mainly comprising (110) surfaces, the second silver halide crystals being conjugated over the one or more surfaces of the first silver halide crystals in the form of one or more projections.

The present invention further provides a method for the preparation of this conjugated silver chlorobromide particle-containing emulsion which is substantially free from silver iodide which comprises forming cubic, rectangular parallelepiped or tetradecahedral first silver halide crystals having six (100) surfaces which may further comprise additional (110) surfaces and then adding thereto an aqueous halide solution and an aqueous silver salt solution in the presence of a crystal habit regulator wherein at least one of the six (100) surfaces of the first silver halide crystals is conjugated with second silver halide crystals mainly comprising (110) crystal surfaces and having a halogen composition different from that of the (100) surfaces of the first silver halide crystals, the second silver halide crystals being conjugated over one or more surfaces of the first silver halide crystals in the form of one or more projections.

23 Claims, 20 Drawing Sheets

SILVER HALIDE EMULSIONS COMPRISING GRAINS WITH (100) SURFACES HAVING CONJUGATED (110) SURFACE CRYSTALS THEREON AND METHOD FOR THE PREPARATION THEREOF

FIELD OF THE INVENTION

The present invention relates to silver halide emulsions and a method for the preparation thereof, more precisely, to novel silver halide photographic emulsions which contain silver halide crystal particles having specific shapes and a method for the preparation thereof.

BACKGROUND OF THE INVENTION

Known silver halides include silver iodide, silver bromide, silver chloride, silver iodochloride, silver chlorobromide, silver iodochlorobromide, etc. A variety of shapes of the silver halide crystals particles (grains) are also known. So-called regularly shaped crystal forms include cubic, octahedral, tetradecahedral, rhombic dodecahedral or the like. Spherical, tabular, amorphous or the like are examples of irregularly shaped crystalline particles. Further, multiphase structural crystal particles having layered structures or conjugate (joined) structures in the particles are also in common use. The halogen composition, shape and structure of these crystal particles are known to influence the characteristics and properties of the silver halide particles, as noted, for example, by T. H. James in *The Theory of the Photographic Process* (4th Ed., Macmillan Co., Ltd., New York) (particularly, the description in the first and third chapters of the properties of silver halides, and the description in the third chapter of the shapes of silver halides, etc.).

Silver halide emulsions may exhibit various characteristics, depending upon the halogen composition of the particles used therein. For example, a silver chloride emulsion has a low sensitivity but has a high solubility and, therefore, is suitable for rapid processing as such an emulsion is capable of undergoing high speed development and fixation. However, fog often occurs in silver chloride emulsions. On the other hand, when a silver bromide emulsion is used, development processing is somewhat slower, but fog hardly occurs, and, further, the light sensitivity of this type of emulsion is high. Silver iodide emulsions are extremely difficult to develop, and, therefore, are rarely used alone in photographic materials. However, mixed silver halide crystals comprising silver iodide and silver bromide exhibit an excellent light sensitivity and, therefore, silver halide emulsions containing such a mixture of crystal particles are extremely important in photographic light-sensitive materials used as camera films.

A variety of techniques have heretofore been known, utilizing the characteristics of various kinds of these silver halides, and there is a substantial amount of literature publications concerning core-shell layered structures of silver halide particles. Typically, the entire surface of the core is coated with one or more shells having a silver halide composition which is different from that of the core. Japanese Patent Publication No. 18939/81 teaches that a silver halide emulsion comprising silver bromide (core) and silver chloride (shell) particles combines the high light sensitivity of the silver bromide and the rapid developability of the silver chloride, but these properties of the two types of silver halide become somewhat suppressed in a mixed crystal type silver chlorobromide emulsion. In addition, German Patent Application (OLS) No. 3,229,999 illustrates that core-shell silver halide particles formed from a silver halide layer having at least 25 mol% silver chloride content and a silver halide layer having a smaller silver chloride content (mol%) than the former, the latter being adjacent to the former, are characterized in that the amount of fog formation is small and the pressure property is good.

U.S. Pat. No. 4,094,684 illustrates an emulsion containing silver halide particles formed by epitaxial growth of silver chloride over polyhedral silver iodide crystal particles. Further, U.S. Pat. No. 4,463,087 illustrates an emulsion containing silver salt particles formed by epitaxial growth of (111) surface-surrounded and silver iodide-containing host silver halide particles and a method for the preparation thereof; and U.S. Pat. No. 4,471,050 illustrates an emulsion comprising silver halide host particles having a face-centered cubic type crystalline structure and non-isomorphous silver salts as projecting only from the edges or corners of the host particles. Furthermore, Japanese Patent Publication No. 24772/83 (corresponding to U.S. Pat. No. 4,496,652) describes cubic silver halide crystals where the corner parts have a different halogen composition from that of the center body part of the crystal, illustrating that it is possible for such crystals to have a selectivity to the introduction of impurities thereinto and to control the crystal defects thereof.

The silver halide particles having this type of structure (as described in Japanese Patent Publication No. 24772/83) are also described by C. Hasse, H. Frieser and E. Klein in *Die Grundlagen der Photographischen Prozesse mit Silberhalogeniden,* Vol. 2 (Akademische Verlagsgesellschaft, Frankfurt an Main, 1968), in which it is stated that the deposition of silver chloride on octahedral silver bromide crystals resulted in the formation of many (100) surface-containing small silver chloride particles on the eight (111) surfaces of the octahedral crystals and that these small particles were attached to the octahedral crystals after the successive deposition of the silver chloride over the crystals to finally form crystalline surfaces of cubic crystals.

According to C.R. Berry and D.C. Skillman in *Journal of Applied Physics,* 35, 7, 2165 (1964), the deposition of silver chloride on octahedral silver bromide particles also causes the epitaxial formation of silver chlorobromide mixed crystals over the (111) surface of the particles, while the deposition of silver chloride on cubic silver bromide particles causes epitaxial growth or projections only at the corners or edges of the cubic crystals.

In the same manner, C.R. Berry mentions in *Photographic Science and Engineering,* 19, 3, 29 (1975) that the deposition of silver chloride on dodecahedral particles having both (111) and (100) surfaces preferentially occurs on the (111) surface most often, whereas deposition on the (110) surface occurs next most often, while deposition on the (100) surface hardly occurs. Further, this publication describes that the deposition of silver chloride occurs more readily on the six tetrasymmetric corners than on the other eight tri-symmetric corners among the two kinds of corners present on dodecahedral particles.

In all of these above-described known techniques and publications concerning silver chlorobromide particles, epitaxial growth selectively occurs on the edges or corners of each crystal, or growth occurs on the (111) surface and (110) surface of the crystal. In the aforesaid core-shell type particles, uniform growth causes the covering (the shell) of all the surfaces of the core particles. Under these circumstances, epitaxial conjugate (joined) particles having a silver halide part selectively conjugated and formed on the (100) surface of the core silver halide particles are not known to exist.

On the other hand, with respect to (110) surface-surrounded rhombic dodecahedral particles, German Pat. No. 2,222,297 (corresponding to U.S. Pat. No. 3,817,756) describes silver chloride and silver chlorobromide particles and Japanese Patent Application (OPI) No. 222842/85 describes silver bromide and silver iodobromide particles (the term "OPI" as used herein refers to a "published unexamined Japanese patent application"). However, the particles obtained by these known methods are rhombic dodecahedral particles themselves having twelve (110) surfaces or polyhedral particles which further have six (100) surfaces or eight (111) surfaces introduced into the dodecahedral particles. Such particles are also described in the above-mentioned *Photographic Science and Engineering,* 19, 3, 29 (1975). However, the shapes of the particles described therein are not defined with particularity, and further, such particles are difficult to obtain by the method described therein. Japanese Patent Application (OPI) No. 83531/86 illustrates silver bromide and silver iodobromide particles which have a groove in the center of the (110) surface. These particles, however, are not conjugate (joined) type particles.

In any event, these known particles described above are rhombic dodecahedral shaped or similarly shaped crystalline particles, and, therefore, the specifically shaped conjugate type particles composed mainly of (110) crystalline surfaces of the present invention are novel.

Development of silver halide particles having a higher sensitivity with less fog formation is a keenly desired goal in the photographic technical field. However, silver halide particles which satisfactorily achieve this goal had not yet been discovered until the present invention described in detail hereinbelow.

SUMMARY OF THE INVENTION

Accordingly, one object of the present invention is to provide silver chlorobromide particles having excellent photographic characteristics and novel crystalline shapes.

A further object of the present invention is to provide a method for the preparation of such silver chlorobromide emulsions.

Still another object of the present invention is to provide silver chlorobromide photographic materials which contain silver chlorobromide particles having excellent developability characteristics and which exhibit higher sensitivity with less fog formation.

The present invention provides novel silver chlorobromide emulsions which are substantially free from silver iodide and which are characterized by containing silver halide crystal particles comprising cubic, rectangular parallelpiped or tetradecahedral silver halide crystals having six (100) surfaces which may further comprise additional (110) surfaces (first silver halide crystals), wherein at least one of the six (100) surfaces of the first silver halide crystals is conjugated (joined) with silver halide crystals (second silver halide crystals) which have a halogen composition different from that of the (100) surfaces of the first silver halide crystals and which mainly comprise (110) crystal surfaces, wherein the second silver halide crystals are conjugated over one or more surfaces of the first silver halide crystals in the form of one or more projections.

The present invention further provides a method for the preparation of these conjugate (joined) silver chlorobromide emulsions which are substantially free from silver iodide which comprises forming cubic, rectangular parallelpiped or tetradecahedral silver halide crystals which may further comprise additional (110) surfaces (first silver halide crystals) and then adding thereto an aqueous halide solution and an aqueous silver salt solution in the presence of a crystal habit regulator (growth modifier) wherein at least one of the six (100) surfaces of the first silver halide crystals is conjugated with silver halide crystals (second silver halide crystals) mainly comprising (110) surfaces and having a halogen composition which is different from that of the (100) surfaces of the first silver halide crystals, wherein the second silver halide crystals are conjugated over one or more surfaces of the silver halide crystals in the form of one or more projections.

The surfaces of the silver halide crystal particles of the present invention, as well as other crystal particles described above, are described with reference to standard Miller index notations, i.e., (100) cubic surfaces, (110) dodecahedral surfaces, and (111) octahedral surfaces.

DETAILED DESCRIPTION OF THE INVENTION

Figure 1:
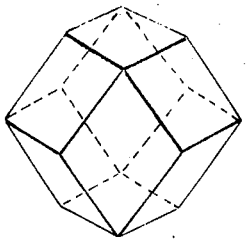
FIG. 1 shows a typical crystal shape of one conventional rhombic dodecahedral particle (grain).
Figure 2A:
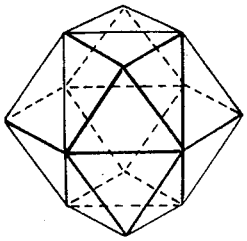
FIG. 2 shows typical crystal shapes of conjugated particles (joined particles) of the present invention, all the surfaces of which are covered with (110) surfaces; (a) shows the shape of a conjugated particle comprising host/guest crystals in a ratio of 1/1, and (b) shows the shape of a conjugated particle where the host crystal also has (110) surfaces.
Figure 2B:
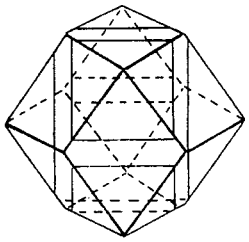
Figure 3A:
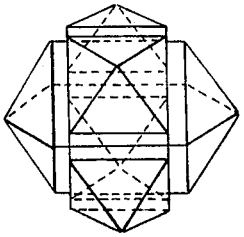
FIG. 3 shows typical crystal shapes of conjugated particles of the present invention where the conjugate (joined) crystals mainly comprise (110) surfaces; (a) shows the shape of a conjugated particle where the (110) surfaces extend up to the tops of the conjugate crystals, and (b) shows the shape of a conjugated particle, where the top of the conjugate crystals is (100) surfaces.
Figure 3B:
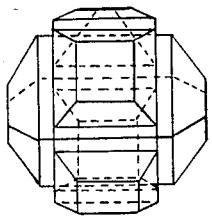

The conjugate (joined) type silver halide particles of the present invention and the method for the preparation thereof are explained in detail below.

The most typical particles within the scope of the present invention comprise cubic, rectangular parallelpiped or tetradecahedral silver halide crystals having six (100) surfaces which may further comprise an additional twelve (110) surfaces (first silver halide crystals), the six (100) surfaces of which are conjugated thereover with the second silver halide crystals described above which have a halogen composition different from that of the first silver halide crystals (the host particles), mostly in the form of projections. The resulting conjugate silver halide particles have a rhombic dodecahedral crystal structure, the outer surface of which is surrounded with (110) surfaces containing the projections. The conjugated second crystals are not limited to conventional (110) surface-containing rhombic dodecahedral crystals, but the corners thereof may be rounded or the crystals may additionally contain (111) surfaces or (100) surfaces. In particular, the (100) surface is most likely to be present on the conjugate crystal surface in the boundary between the host crystal and the conjugate crystal. In any event, the conjugated crystals of the present invention will perform their intended function as long as the surface of the conjugate or second crystal, which is not adjacent to the host crystal, is surrounded mainly with (110) surfaces.

Further, the conjugated second crystals which are not formed and grown on the same (100) surface of the host crystal are adjacent and bound to each other, and may also cover portions of edges and corners of the first silver halide crystals (referred to as "host crystals" hereinafter). Alternatively, the second or conjugate crystals do not necessarily have to be formed on all six of the (100) surfaces of the host crystals; for example, the second crystals may be conjugated on four or five of the (100) surfaces. Conjugated particles where the second crystals are only formed on one of the (100) surfaces are also included in the scope of the present invention.

More specifically, the second silver halide crystals which have a different halogen composition from that of the host crystals are to be conjugated and grown on at least one (100) surface of the host crystals, preferably two or more (100) surfaces thereof, and most preferably all six (100) surfaces thereof, in order to satisfy the objects of the present invention. The second silver halide crystals thus conjugated may cover all the respective (100) surfaces of the host crystals, or alternatively, may cover only parts thereof. Further, the second crystals which are conjugated on different crystal surfaces may be attached or bound to each other, as mentioned above.

The host crystals are most preferably silver halides of cubic crystals, rectangular parallelpiped crystals, tetradecahedral crystals which may further comprise an additional twelve (110) surfaces. The edges and corners of these host crystals may be rounded, and the overall shape of these cubic crystals, rectangular parallelpiped crystals or tetradecahedral crystals need not necessarily be definite, and those host crystals containing additional (110) surfaces need not necessarily be definite, as long as the host crystals have (100) surfaces onto which the second silver halide crystals can be conjugated as described above. All of these types of host silver halide crystals can be used in the formation of the conjugated particles of the present invention.

The ratio of the silver halide constituting the host crystal particle to the silver halide constituting the second crystal particle which is to be conjugated and grown on the host particle is not necessarily limited. However, if the ratio of the latter to the former is too small, a definite conjugate structure can not be observed or the (110) surfaces are difficult to discern; on the other hand, if the ratio is too large, all of the second silver halide crystals cannot be completely conjugated on the host crystals so as to result in the formation of differnt, new crystal particles, or the second crystals will entirely cover all the surfaces of the host crystals and will be linked together thereon, resulting in two-layered structural crystal particles wherein the conjugated structure of the particles of the present invention cannot be discerned. Accordingly, the ratio of the silver halide constituting the host crystals and the second crystals, respectively, is preferably about 0.1 mol/mol to about 6 mols/mol.

In order to obtain uniform formation and growth of the conjugate crystals over the host crystals, uniformity of the shape of the host crystals as well as high monodispersivity of the particle size distribution of the host particles are desired. If, on the other hand, the host crystals have a broad particle size distribution, silver halide emulsions can be obtained containing various conjugated particles having differing silver amount ratios between the conjugate crystals and host crystals, by appropriately regulating the addition speed of the water-soluble silver salt and the water-soluble halide during the formation of the second silver halide crystals to be conjugated over the host crystals.

A variation coefficient (which is determined as the value obtained by dividing the standard deviation of the particle size distribution (s) by the mean particle size ($\bar{\gamma}$): ($s/\bar{\gamma}$) of the monodispersed emulsion according to the present invention is not more than 0.20, preferably not more than 0.15.

The conjugated particles comprising the silver halide emulsions of the present invention are present in a ratio of particles where the second crystals are formed on all six (100) surfaces of the host crystals to the total conjugated crystals (i.e., including those wherein the second crystals are conjugated on less than all six (100) surfaces of the host crystals). This ratio is desirably about 40% or more (calculated on the basis of the total number of crystals in the emulsion or based on the weight thereof). Further, the emulsion contains preferably about 90% or more of the conjugated particles where the second silver halide crystals are conjugated to at least one of six (100) surfaces of said first silver halide crystals as calculated on the basis of the total number or weight of particles in the emulsion; the emulsion contains about 85% or more of the conjugated particles where the second silver halide crystals are conjugated to at least three of six (100) surfaces of said first silver halide crystals as calculated on the basis of the total number or weight of particles in the emulsion; and the emulsion contains about 60% or more of the conjugated particles where the second silver halide crystals are conjugated to at least four of six (100) surfaces of said first silver halide crystals as calculated on the basis of the total number of weight of particles in the emulsion.

The ratio of the conjugated crystal particles where the second crystals formed on different (100) surfaces of the same host crystal are bound together (i.e., linking together over the edge portions of the (110) surfaces of the host crystal, or where the second crystals are bound together in such a way that they cover the corner portions of the host crystal or the (111) surfaces of the tetradecahedral host crystal) to the total conjugated crystals desirably does not exceed about 80% of the total number or weight of the crystal particles in the emulsion. In this regard, conjugated crystals wherein six or more edges portions from among the twelve edge portions of the host crystal are not bound together by the second crystal are acceptable for purposes of the present invention. Further, conjugated crystals wherein eight corner portions of the host crystal or four or more surfaces from among the (111) surfaces thereof have remained uncovered are also acceptable.

The wording "the second conjugate silver halide crystals are conjugated over one or more surfaces of the first host silver halide crystals in the form of one or more projections" as used herein means that the surfaces of the host crystals have either remained uncovered by the second crystals after the conjugation of the second crystals on the host crystals, or the second crystals do not entirely cover all of the surfaces of the host crystals in the resulting conjugated crystal particles.

The halogen composition of the host crystals may be silver bromide, silver chlorobromide, silver chloride, etc. The silver chlorobromide crystals may comprise any silver halide composition, i.e., where the content of the silver chloride varies from 0 mol% to 100 mol%, with 100 mol% being exclusive of silver bromide. The wording "substantially free from silver iodide" means that the proportion of the content of silver iodide is about 2 mol% or less, preferably 1 mol% or less, and most preferably, the silver iodide content is zero.

The halogen composition of the second silver halide crystals to be conjugated on the host crystals may be silver bromide, silver chlorobromide or silver chloride; in particular, silver chlorobromide and silver chloride are especially preferred as the second silver halide conjugate crystals. If the second crystals contain silver iodide, the content thereof is desirably about 2 mol% or less. The halogen compositions of the conjugate crystals and the host crystals are desirably differentiated from each other by at least 1 mol% or more silver chloride.

The formation of the conjugated particles of the present invention begins with the preparation of the host crystals. The cubic particles, rectangular parallelepiped particles and tetradecahedral particles are prepared, for example, by blending a soluble silver salt aqueous solution and a soluble halide aqueous solution under the condition of a constant silver ion concentration. If silver chloride is present in the reaction system, the silver ion concentration is not necessarily required to be kept constant during the formation of the host crystals. The formation of these crystal particles is well-documented in pertinent literature and publications, for example, in the above-mentioned *Die Grundlagen der Photographischen Prozesse mit Silberhalogeniden,* etc. Further, these crystal particles can be formed by the method as reported in E. Moiser and E. Klein, *Physicochemistry, Bunsen Association Report,* Vol. 67 (1963). The formation of the cubic, rectangular parallelepiped or tetradecahedral crystal particles comprising additional (110) surfaces will be described hereinafter.

The host crystal particles may be of a so-called two-layered structure wherein the internal portion or the core portion of the particle has a different halogen composition from that of the outer portion thereof or may have any other structure, so long as the surface or the shell portion of the crystal particle has a different halogen composition from the second silver halide crystals.

The formation of the second or conjugate crystals over the host silver halide crystals follows the formation of the host crystals, and can be effected by adding a soluble halide aqueous solution which has a different halogen composition from that of the host crystals and a soluble silver salt aqueous solution to the previously formed host crystals in the presence of a crystal habit regulator ("growth modifier" described hereinafter), and precipitated thereover. During the formation of the conjugated crystal in this manner, the silver ion concentration is more preferably kept constant. Where the host crystals and second crystals comprise silver chlorobromide, conjugated crystals with a uniform conjugation between the host and conjugate particles can often be formed even through the silver ion concentration is not kept constant during the formation of the conjugate crystals. In particular, if the content of silver chloride of the host crystals and second crystals is high, the aqueous halide solution can first be added to the suspension of host silver halide crystals and then the silver salt aqueous solution can be added thereto, or as the case may be, the silver salt aqueous solution can be added thereto later, whereby the desired conjugated particles can be obtained.

The soluble halide aqueous solution and silver salt aqueous solution used to form the conjugate crystals are added to the host silver halide crystals at a maximum addition speed falling within the range such that the addition of these solutions does not cause the formation of any new nuclei, the conjugate crystals then are precipitated over the host crystals, so that the resulting conjugated silver halide crystals may have a composition which is close to the stoichiometrical composition of the aqueous halide solution initially added and the composition of the host silver halide crystals remains almost the same as the initial composition.

However, if these formation conditions for the resulting conjugated particles are not used, or if the particles are physically ripened after the formation thereof using the above-described formation conditions, the soluble halide aqueous solution added or the second silver halide crystals formed and the host silver halide particles will recrystallize or will undergo halogen conversion whereby the composition of the conjugated silver halide crystals formed will be different from the stoichiometrical composition of the soluble halide aqueous solution added to the host crystals and, therefore, the composition of the host silver halide crystals themselves, after being conjugated, will often be different from that of the initial host crystals. In the formation of particles of the present invention, however, such compositional variation does not occur in most cases because of the presence of the crystal habit regulator; on the other hand, such variations can easily be made to occur, if desired. The variations in the halogen compositions of the host silver halide crystals and the conjugate silver halide crystals, which will result from the above-noted recrystallization or the like, or variations in the molar ratio of the halogen compositions constituting the host crystals and the conjugated crystals, are noted to be more remarkable where there is a larger difference between the halogen compositions of the host crystals and the conjugate crystals, or the silver halides as used have a higher solubility. Even though such variations may have occurred, silver halide emulsions containing the conjugated particles with the shapes as defined in the present invention can be obtained.

Where the halide used to form the second silver halide crystals is of the same halogen composition as that of the host silver halide crystals, formation of the conjugated particles of the present invention is impossible, since the particles will grow to form multilayered structural or core-shell structural particles. The differentiation of the halogen compositions between the host silver halide crystals and the second silver halide crystals is considered to be essential in the formation of the conjugated crystal particles of the present invention. Since the conjugated particles of the present invention have different halogen compositions beteen the host crystal part and the conjugate crystal part, recrystallization sometimes occurs during the formation of the particles which causes the fusion of the conjugate crystals or the incorporation of the conjugate crystals into the host crystals themselves. The result of such interaction is that the particles formed sometimes could not have a conjugated structure. Such particles with no conjugated structure are outside the scope of the present invention.

In order to inhibit the formation of such non-conjugated particles falling outside the scope of the present invention, for example, the conjugated crystal-forming speed during the formation of the second silver halide crystals should be higher than the speed at which non-conjugated crystals are formed due to recrystallization or Ostwald's ripening. To achieve this aim, the speed of the addition of the silver salt aqueous solution and/or the soluble halide aqueous solution for the formation of the second silver halide crystals should be established near to the critical speed necessary for the growth of the conjugated crystals. Specifically, this addition speed is to be determined so that if the soluble halide and silver salt solutions are added at a higher speed than the determined speed, the solutions would not be deposited on the already formed host crystal particles to form the second conjugate crystals thereon, but would form different, new crystal nuclei. If the addition speed is higher than the critical growth speed, the formation of new crystal nuclei occurs, and as mentioned above, does not always inhibit the formation of the conjugated crystals. Further, if the addition speed is lower than the critical growth speed, crystallization of the conjugated crystals being formed occurs, but depends upon a larger difference between the addition speed and the critical growth speed, whereby the conjugated crystals will be difficult to form.

The critical growth speed as referred to herein varies depending upon the conditions for the formation of the crystals. For example, such conditions include the temperature, the silver ion concentration in the reaction system, the stirring speed or other blending conditions, and after the determination of the conditions for the actual formation of the particles, the critical growth speed can be experimentally determined by observing the existence of any newly formed crystals by an electron microscope. Further, the critcal growth speed also varies depending upon the specific crystal habit regulator employed.

In the present invention, it is fairly difficult to indiscriminately and uniformly define the range of the conditions used in the formation of the conjugated crystals in view of the above-mentioned variables and concerns. In general, however, the addition speed of the silver ion and/or the halide ion desirably falls within the range of from about 0.1 to about 5 times the critical growth speed of the particles. In particular, this range is more preferably from 0.15 to 3 times.

If the above-mentioned crystal habit regulator is not used in the process of the present invention, the conjugated particles of the present invention having projecting conjugate crystals comprising mainly (110) surfaces could not be formed. Even if the conjugated particles could be formed, the second crystals would not mainly comprise (110) surfaces, or even worse, no conjugated particles would be formed.

The "crystal habit regulator" as referred to herein includes compounds that can accelerate the development of the (110) crystal surfaces when the second silver halide particles are formed in an aqueous medium in the presence of a hydrophilic protective colloid, for example, those as illustrated in Japanese Patent Application (OPI) No. 222842/85 (corresponding to European Pat. No. 159,045 A2). Further, some of the compounds described in German Pat. No. 2,222,297 (corresponding to U.S. Pat. No. 3,817,756) and their analogous compounds can also be used. However, all of the compounds described in these publications are not always effective as the crystal habit regulator of the present invention. Moreover, if the amount of the regulator present during the formation of the conjugated particles is not appropriate, the conjugated particles of the present invention could not be obtained. Specifically, if the amount of regulator is too small, the resulting conjugated crystals which are surrounded mainly by (110) surfaces could not be formed or, as the case may be, no conjugated particles themselves could be formed, as mentioned above. If, on the contrary, the amount of regulator is too large, the conjugation would be interrupted.

The chemical structures of the crystal habit regulators which are effective in the present invention are difficult to precisely define. However, preferred compounds include mercaptotetrazole type compounds, mercaptotriazole type compounds, mercaptothiadiazole type compounds, hydroxyazaindenes, merocyanine dyes having a rhodanine nucleus or a thiohydantoin nucleus, as well as certain kinds of cyanine dyes such as benzothiadicarbocyanine, etc.

Other silver halide adsorptive compounds present during the formation of the conjugated particles will sometimes inhibit the formation of the conjugated particles of the present invention. Many of the cyanine dyes will inhibit the formation of the conjugated particles, if present during the formation of the second silver halide crystals, whereby the resulting shapes of the silver halide particles formed will often be cubic or rectangular parallelepiped. However, such compounds having this type of inhibitory activity are sometimes effective for stabilizing the shapes of the already formed conjugated particles, and, therefore, these compounds can be used in the process of the present invention within amounts that will not inhibit the formation of the conjugated particles. The shapes of the conjugated particles of the present invention can be easily varied depending upon the temperature or pAg of the emulsion or the kind and the amount of the crystal habit regulator, and the conjugated particles do not always have the required (110) surfaces selectivity. In such a case, some silver halide adsorptive compounds can be added during the formation of the particles in order to impart (110) surface selectivity to the resulting conjugated particles.

The co-use of a compound which accelerates the formation of the conjugated particles of the present invention and a compound which does not accelerate such formation makes it possible to vary the conjugated shapes of the conjugated particles or the halogen distribution in the particles.

Further, additional third and fourth silver halides can be conjugated over the second conjugate silver halide crystals of the conjugated crystals of the present invention, if desired.

The crystal habit regulator as used in the present invention is added to the reaction system prior to the completion of the formulation of the conjugated crystals, preferably prior to the formation of about 70 mol% of the conjugated crystals, more preferably prior to the formation of 40 mol% of the conjugated crystals, and most preferably prior to the beginning of the formation of the conjugated crystals.

The crystal habit regulator can also be added to the reaction system prior to the formation of the host crystals or during the formation thereof. In this case, the presence of the regulator will sometimes cause the variation of the cubic, rectangular parallelepiped or tetradecahedral shapes of the host crystals to different shapes having an additional twelve (110) surfaces. This depends upon the kind or the amount of the crystal habit regulator used or the time of the addition thereof. Even in such a case, the host crystals can still be used in the present invention so long as they still comprise the necessary (110) surfaces on which the second conjugate crystals can be formed and grown to form the desired conjugated particles of the present invention.

The crystal habit regulator is not always necessarily added at one time. The addition amount may be divided into several parts, and each part may then appropriately be added in each stage of the growth of the particles. Alternatively, the regulator may gradually be added at a constant speed or an accelerated speed, as with the addition of the silver salt aqueous solution or the soluble halide aqueous solution described above. Any combination of these addition methods can also be used in the present invention.

The amount of the mercaptotetrazole type compound to be added, one type of crystal habit regulator which may be used herein, is preferably from about $2\times10^{-5}$ to about $2\times10^{-2}$ mol, more preferably $5\times10^{-5}$ to $1\times10^{-2}$ mol, and most preferably $1\times10^{-4}$ to $5\times10^{-3}$ mol, per mol of the Ag ion used for the formation of the conjugated crystals.

Suitable amounts of the mercaptothiadiazole type compound to be added is the same as that just described for the mercaptotetrazole type compound.

The amount of the hydroxyazaindene type crystal habit regulator is, in the same manner, preferably about $2\times10^{-4}$ to about $2\times10^{-1}$ mol, more preferably $5\times10^{-4}$ to $1\times10^{-1}$ mol, per mol of the Ag ion used for the formation of the conjugated crystal. The amount of the cyanine dye and that of the merocyanine dye which may be added each is, also in the same manner, preferably about $2\times10^{-5}$ to about $2\times10^{-2}$ mol, more preferably $5\times10^{-5}$ to $1\times10^{-2}$ mol, per mol of the Ag ion used for the formation of the conjugated crystals.

The mercaptotetrazole type compounds which are preferably used in the present invention can be selected from those represented by the following general formula (I):

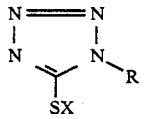

(I)

wherein R represents an alkyl group, an alkenyl group or an aryl group, and X represents a hydrogen atom, an alkali metal atom, an ammonium group or a precursor. The alkali metal atom includes, for example, a sodium atom, a potassium atom, etc.; the ammonium group includes, for example, a trimethylammonium chloride group, a dimethylbenzylammonium chloride group, etc. The precursor is a group which may be a hydrogen atom or an alkali metal under an alkaline condition, for example, including an acetyl group, a cyanoethyl group, a methanesulfonylethyl group, etc.

The alkyl group and the alkenyl group representative of R in general formula (I) include unsubstituted groups and substituted groups, and additionally, alicyclic groups. Examples of the substituents in the substituted alkyl groups are a halogen atom, an alkoxy group, an aryl group, an acylamino group, an alkoxycarbonylamino group, a ureido group, a hydroxyl group, an amino group, a heterocyclic group, an acyl group, a sulfamoyl group, a sulfonamido group, a thioureido group, a carbamoyl group, and additionally, a carboxylic acid group, a sulfonic acid group and a salt thereof, etc.

The ureido group, thioureido group, sulfamoyl group, carbamoyl group and amino group mentioned as substituents for the alkyl groups may be unsubstituted or may be N-alkyl-substituted or N-aryl-substituted.

Examples of the aryl group for R are a phenyl group and substituted phenyl groups; the substituents on the substituted phenyl groups include an alkyl group and the substituents suitable for substituted alkyl groups in the above description.

The mercaptothiadiazole type compounds which are preferably used in the present invention can be selected from those represented by the following general formula (II):

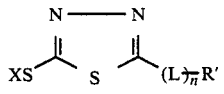

(II)

wherein L represents a divalent linking group; R′ represents a hydrogen atom, an alkyl group, an alkenyl group or an aryl group; and n represents 0 or 1. The alkyl group and alkenyl group for R′ as well as X have the same meanings as described above in general formula (I).

Examples of the divalent linking group represented by L include

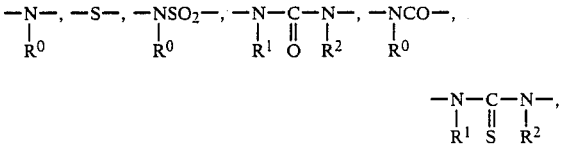

etc., wherein $R^0$, $R^1$ and $R^2$, which may be the same or different, each represents a hydrogen atom, an alkyl group or an aralkyl group.

The hydroxyazaindenes which are preferably used in the present invention can be selected from those represented by the following general formula (III):

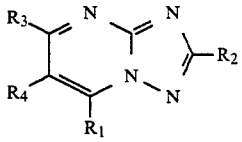

(III)

wherein $R_1$, $R_2$, $R_3$ and $R_4$ may be the same or different and each represents a hydroxyl group, an alkyl group, an alkenyl group, an aryl group, a cyano group, a ureido group, an amino group, a halogen atom or a hydrogen atom, with the proviso that the number of hydroxyl groups in the formula is to be 1 or 2.

The above-mentioned alkyl group, alkenyl group, aryl group, ureido group and amino group may be substituted in the same manner as described above for these same groups in the above-mentioned general formula (I). Especially preferred substituents for the alkyl group are an aryl group, an alkoxycarbonyl group, a carbamoyl group, a cyano group, an amino group and a sulfonamido group.

Further, $R_3$ and $R_4$ may be linked together to form a 5- or 6-membered, saturated or unsaturated carbon ring.

Typical examples of the crystal habit regulators which can be used in the formation of the conjugated particles of the present invention include the following compounds:

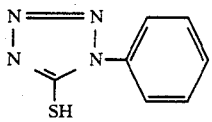
(1)

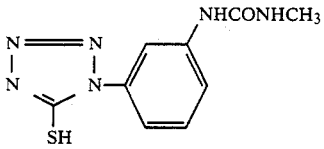
(2)

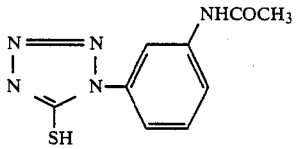
(3)

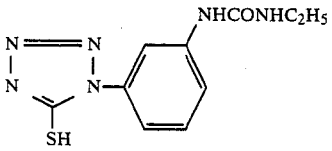
(4)

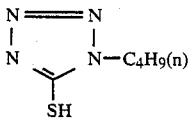
(5)

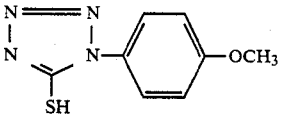
(6)

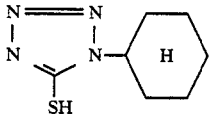
(7)

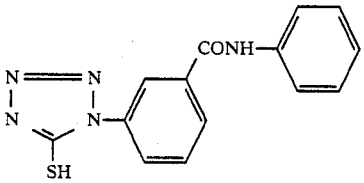
(8)

-continued

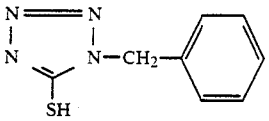
(9)

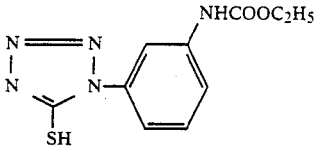
(10)

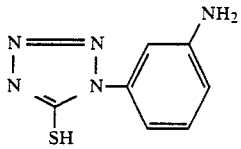
(11)

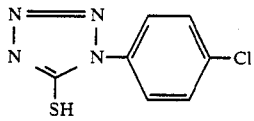
(12)

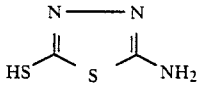
(13)

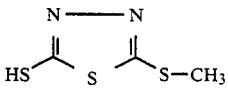
(14)

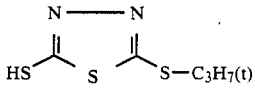
(15)

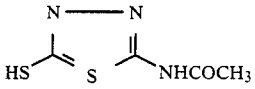
(16)

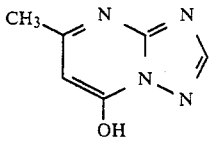
(17)

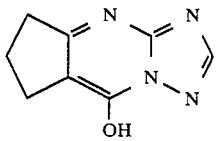
(18)

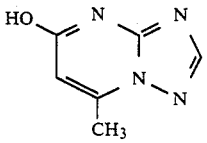
(19)

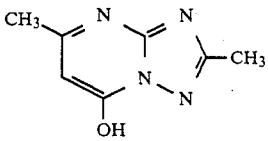
(20)

-continued (21)

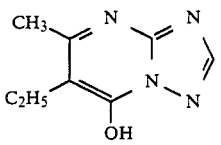

(22)

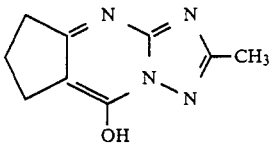

(23)

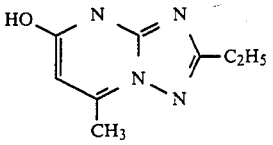

(24)

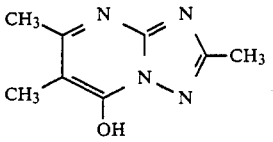

(25)

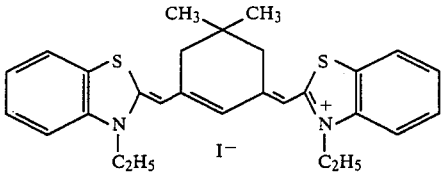

(26)

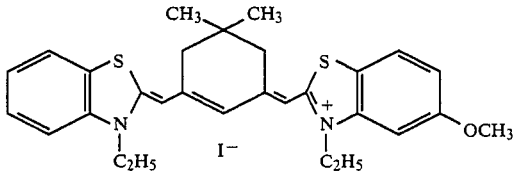

(27)

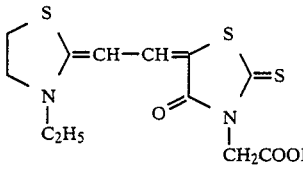

(28)

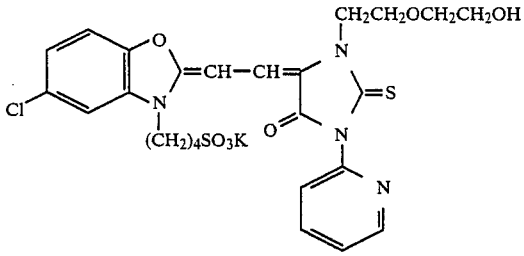

The silver halide emulsions of the present invention may be chemically sensitized. For instance, various known methods may be used for the chemical sensitization, including a sulfur sensitization method in which a sulfur-containing compound capable of reacting with an active gelatin and silver (such as a thiosulfate, a thiourea, a mercapto compound, or a rhodanine compound) is used; a reduction sensitization method in which a reducing substance (such as stannous salt, an amine compound, a hydrazine derivative, a formamidinesulfinic acid, or a silane compound) is used; and a noble metal sensitization method in which a noble metal compound (such as a gold complex or a Pt-, Ir-, Pd- or other Periodic Table VIII group metal-complex) is used. These sensitization methods may be used alone or in combination.

The photographic emulsions of the present invention can contain a variety of compounds for the purpose of the prevention of the occurrence of fog during the manufacture and preservation of the photographic light-sensitive materials and for the stabilization of the photographic characteristics of the materials. For instance, a variety of compounds which are known as fog inhibitors or stabilizers can be added to the materials for these purposes, including azoles such as benzothiazolium salts, nitroindazoles, triazoles, benzotriazoles, and benzimidazoles (especially nitro- or halogen-substituted forms); heterocyclic mercapto compounds such as mercaptothiazoles, mercaptobenzothiazoles, mercaptobenzimidazoles, mercaptothiadiazoles, mercaptotetrazoles (especially 1-phenyl-5-mercaptotetrazole and substituted derivatives thereof), and mercaptopyrimidines; the above-mentioned heterocyclic compounds which further contain a water-soluble group such as a carboxyl group or a sulfone group; thioketo compounds such as oxazolinethiones; azaindenes such as tetraazaindenes (especially 4-hydroxy-substituted (1,3,3a,7)tetraazaindenes); benzenethiosulfonic acids; benzenesulfinic acids, etc.

The photographic emulsions of the present invention can contain further additives for the purpose of increasing sensitivity, increasing the contrast or the acceleration of developability. Examples of such additives include polyalkylene oxides or ethers, esters, amines or similar derivatives thereof, thioether compounds, thiomorpholines, quaternary ammonium salt compounds, urethane derivatives, urea derivatives, imidazole derivatives and 3-pyrazolidones.

Any known water-soluble dyes can be incorporated in the silver halide photographic emulsions of the present invention (for example, oxonol dyes, hemioxonol dyes or merocyanine dyes) as a filter dye or for the purpose of irradiation prevention or for any other various purposes. In addition, any other known cyanine dyes, merocyanine dyes, hemicyanine dyes or the like can also be incorporated in the emulsions before, during or after the chemical sensitization thereof as a spectral sensitizer or for the purpose of controlling the crystal shape or the size of the silver halide particles.

The silver halide photographic emulsions of the present invention can contain color couplers such as cyan couplers, magenta couplers or yellow couplers or compounds containing a dispersion of these couplers. The couplers to be incorporated are preferably non-diffusible because of the presence of a ballast group therein or their having been polymerized. Suitable color couplers include 2-equivalent color couplers where the coupling active position is substituted by a releasing group are preferred over 4-equivalent color couplers where the coupling active position is occupied by a hydrogen atom, since the amount of the silver in the emulsion to be coated can be reduced when using 2-equivalent couplers. In addition, couplers that can form colored dyes with a pertinent diffusibility, non-coloring couplers, DIR couplers which can release a development inhibitor upon undergoing a coupling reaction or couplers which can release a development accelerator upon undergoing a coupling reaction, can also be used.

Typical examples of the yellow couplers which can be used in the present invention are oil-protect type acylacetamide couplers. Specific examples thereof are described in, e.g., U.S. Pat. Nos. 2,407,210, 2,875,057 and 3,265,506. In particular, 2-equivalent yellow couplers are preferably used in the present invention, and typical examples thereof are oxygen atom-releasing type yellow couplers as described in, e.g., U.S. Pat. Nos. 3,408,194, 3,447,928, 3,933,501 and 4,022,620; and nitrogen atom-releasing type yellow couplers as described in, e.g., Japanese Patent Publication No. 10739/83, U.S. Pat. Nos. 4,401,752 and 4,326,024, *Research Disclosure,* No. 18053 (April, 1979), British Pat. No. 1,425,020, and German Patent Application (OLS) Nos. 2,219,917, 2,261,361, 2,329,587 and 2,433,812. In particular, α-pivaloylacetanilide type couplers are excellent in fastness, especially light fastness, of the colored dyes; on the other hand, α-benzoylacetanilide type couplers can form colored dyes with high color density.

The magenta couplers which can be used in the present invention include, for example, oil-protect type indazolone or cyanoacetyl couplers, preferably 5-pyrazolone or pyrazoloazole couplers such as pyrazolotriazoles. The 5-pyrazolone type couplers where the 3-position is substituted by an arylamino group or an acylamino group are preferred in view of the hue and color density of the colored dyes; typical examples thereof are described in, e.g., U.S. Pat. Nos. 2,311,082, 2,343,703, 2,600,788, 2,908,573, 3,062,653, 3,152,896 and 3,936,015. Releasing groups in the 2-equivalent 5-pyrazolone type couplers include nitrogen-releasing groups as described in U.S. Pat. No. 4,310,619 and arylthio groups as described in U.S. Pat. No. 4,351,897. In addition, ballast group-containing 5-pyrazolone type couplers as described in European Pat. No. 73,636 are preferred, due to their ability to form colored dyes with high color density.

The pyrazoloazole type couplers which can be used in the present invention include, for example, pyrazolobenzimidazoles as described in U.S. Pat. No. 3,369,879, preferably pyrazolo[5,1-c][1,2,4]triazoles; pyrazolotetrazoles as described in *Research Disclosure,* No. 24220 (June, 1984); and pyrazolopyrazoles as described in *Research Disclosure,* No. 24230 (June, 1984). In particular, imidazo[1,2-b]pyrazoles as described in European Pat. No. 119,741 are preferred due to their small amount of yellow side absorption and high light fastness; and pyrazolo[1,5-b][1,24]triazoles as described in European Pat. No. 119,860 are especially preferred.

The cyan couplers which can be used in the present invention include, for example, oil-protect type naphthol or phenol couplers; typical examples thereof are naphthol type couplers as described in U.S. Pat. No. 2,474,293, preferably oxygen atom-releasing type 2-equivalent naphthol couplers as described in U.S. Pat. Nos. 4,052,212, 4,146,396, 4,228,233 and 4,296,200. In addition, specific examples of phenol type couplers are described in, e.g., U.S. Pat. Nos. 2,369,929, 2,801,171, 2,772,162 and 2,895,826. In particular, cyan couplers that are fast to moisture and temperature are preferably used in the present invention; typical examples thereof are phenol type cyan couplers which have an ethyl or higher alkyl group in the m-position of the phenol nucleus, as described in U.S. Pat. No. 3,772,002; 2,5-diacylamino-substituted phenol type couplers as described in U.S. Pat. Nos. 2,772,162, 3,758,308, 4,126,396, 4,334,011 and 4,327,173, German Patent Application (OLS) No. 3,329,729 and Japanese Patent Application (OPI) No. 166956/84; and phenol type couplers having a phenylureido group in the 2-position and an acylamino group in the 5-position, as described in U.S. Pat. Nos. 3,446,622, 4,333,999, 4,451,559 and 4,427,767.

The graininess can be improved by the incorporation of a coupler capable of forming a colored dye with suitable diffusibility. Such dye-diffusible couplers include the magenta couplers as described in U.S. Pat. No. 4,366,237 and British Pat. No. 2,125,570, and the yellow, magenta or cyan couplers as described in European Pat. No. 96,570 and German Patent Application (OLS) No. 3,234,533.

The dye-forming couplers and the above-mentioned special couplers may be in the form of a dimer or higher polymer. Typical examples of these polymerized dye-forming couplers are described in U.S. Pat. Nos. 3,451,820 and 4,080,211. Specific examples of the polymerized magenta couplers are described in British Pat. No. 2,102,173 and U.S. Pat. No. 4,367,282.

Two or more kinds of these couplers can be incorporated in the same light-sensitive layer, or the same coupler can be incorporated in two or more different layers in order that the photographic materials employing the emulsions of the present invention can have the necessary characteristics.

The standard amount of the color coupler to be used is within about 0.001 to about 1 mol per mol of the light-sensitive silver halide, and preferably the amount of the yellow coupler is from about 0.01 to about 0.5 mol, that of the magenta coupler is from about 0.003 to about 0.3 mol and that of the cyan coupler is from about 0.002 to about 0.3 mol, each per mol of the silver halide.

The photographic light-sensitive materials to be formed in accordance with the present invention can contain hydroquinone derivatives, aminophenol derivatives, amines, gallic acid derivatives, catechol derivatives, ascorbic acid derivatives, non-coloring couplers, sulfonamidophenol derivatives, etc., as color fog inhibitors or color stain inhibitors.

The photographic light-sensitive material of the present invention can further contain a known discoloration inhibitor. Typical examples of suitable organic discoloration inhibitors are hindered phenols such as hydroquinones, 6-hydroxychromans, 5-hydroxycoumarans, spirochromans, p-alkoxyphenols and bisphenols, and gallic acid derivatives, methylenedioxybenzenes, aminophenols, hindered amines, as well as ether and ester derivatives thereof where the phenolic hydroxyl group in the compound is silylated or alkylated. In addition, metal complexes such as (bissalicylaldoximato)nickel complexes and (bis-N,N-dialkyldithiocarbamato)nickel complexes can also be used.

Compounds having both partial structures of a hindered amine and a hindered phenol in 1 molecule, as described in U.S. Pat. No. 4,268,539, are effective for the prevention of the deterioration of the yellow colored images under conditions of heat, moisture and light. Spiroindanes as described in Japanese Patent Application (OPI) No. 159644/81 and hydroquinone-diether- or -monoether-substituted chromans as described in Japanese Patent Application (OPI) No. 89835/80 are effective for the prevention of the deterioration of the magenta colored images, especially under light.

Benzotriazole type ultraviolet absorbents are preferably used for improving the preservation stability, especially light fastness, of the cyan images. The ultraviolet absorbent can be co-emulsified together with the cyan coupler.

The amount of the ultraviolet absorbent to be coated is enough to be satisfactory for imparting light stability to the cyan colored images. If, however, the amount is too large, the non-exposed part (white background part) of the color photographic material will be tinted yellow, and, therefore, the amount, in general, preferably should fall within the range of about $1\times10^{-4}$ mol/m$^2$ to about $2\times10^{-3}$ mol/m$^2$, especially $5\times10^{-4}$ mol/m$^2$ to $1.5\times10^{-3}$ mol/m$^2$.

In the constitution of the light-sensitive layers of generally used color papers, the ultraviolet absorbent is incorporated into one or preferably both of the layers adjacent to both sides of the cyan coupler-containing red-sensitive emulsion layer. When the ultraviolet absorbent is added to the intermediate layer between the green-sensitive emulsion layer and the red-sensitive emulsion layer, it may be co-emulsified together with the color stain inhibitor. If the ultraviolet absorbent is added to the protective layer, another protective layer can be provided thereon as an outermost layer. The protective layer can contain a matting agent or the like, having any desired grain size.

The photographic light-sensitive materials of the present invention can also contain the ultraviolet absorbent in the hydrophilic colloid layer.

The photographic light-sensitive materials of the present invention can contain a whitening agent such as stilbene type, triazine type, oxazole type, coumarin type or the like compounds, in the photographic emulsion layers or in other hydrophilic colloid layers. The whitening agents to be used may be water-soluble, or, as the case may be, water-insoluble whitening agents can also be used in the form of a dispersion thereof.

As mentioned above, the emulsion of the present invention can be adopted to multilayer and multicolor photographic materials having at least two layers of different spectral sensitivities on a support. Multilayer natural color photographic materials have, in general, at least one red-sensitive emulsion layer, at least one green-sensitive emulsion layer and at least one blue-sensitive emulsion layer on a support. The order of these layers to be provided on the support can be selected freely depending on the desired results. Each of the emulsion layers may comprise two or more layers having different degrees of sensitivity, or a light-insensitive layer may be provided between two or more layers having the same color sensitivity.

The photographic light-sensitive materials of the present invention preferably have auxiliary layers such as a protective layer, an intermediate layer, a filter layer, an antihalation layer and a backing layer, in addition to the silver halide emulsion layers, as desired.

Gelatin is advantageously used as the binder or protective colloid to be incorporated into the emulsion layer or intermediate layer of the photographic light-sensitive materials of the present invention; other known hydrophilic colloids can, of course, also be used, for instance, proteins such as gelatin derivatives, graft polymers of gelatin and other high molecular weight substances, albumin, or casein; cellulose derivatives such as hydroxyethyl cellulose, carboxymethyl cellulose, or cellulose sulfates; saccharide derivatives such as sodium alginate or starch derivatives; homo- or copolymers comprising various synthetic hydrophilic high molecular weight substances such as polyvinyl alcohol, partially acetalized polyvinyl alcohol, poly-N-pyrrolidone, polyacrylic acid, polymethacrylic acid, polyacrylamide, polyvinyl imidazole, polyvinyl pyrazole, etc.

Gelatins which can be used in the present invention include lime-treated gelatin, acid-treated gelatin and enzyme-treated gelatin as described in *Bull. Soc. Sci. Phot. Japan,* No. 16, page 30 (1966); in addition, hydrolyzed or enzyme-decomposed products of gelatins can also be used.

The finished emulsions are coated on a suitable support, for example, a baryta paper, a resin-coated paper, a synthetic paper, a triacetate film, a polyethylene terephthalate film or a similar plastic base, or a glass plate.

The silver halide photographic materials containing the novel emulsions of the present invention can be utilized, for example, in color positive films, color papers, color negative films, color reversal films (containing or not containing couplers), photographic light-sensitive materials for photomechanical processes (such as lith films, lith-dupe films), light-sensitive materials for cathode ray tube display, light-sensitive materials for X-ray recording, light sensitive materials for silver salt diffusion transfer processes, light-sensitive materials for color diffusion transfer processes, light-sensitive materials for imbibition transfer processes, emulsions to be used in silver dye bleaching processes, light-sensitive materials for recording printout images, light-sensitive materials for direct print images, light-sensitive materials for heat development, light-senstive materials for physical development, etc.

The exposure for obtaining the photographic images can be carried out in a conventional manner. For instance, any one of various known light sources can be used for the exposure, including, for example, natural light (daylight), a tungsten lamp, a fluorescent lamp, a mercury lamp, a xenon arc lamp, a carbon arc lamp, a xenon flash lamp, a cathode ray tube flying spot, etc. The exposure time may be from about 1/1,000 second to about 1 second, which is a common exposure time for most cameras. Further, a shorter exposure time than 1/1,000 second, for example, from $1/10^4$ to $1/10^6$ second by the use of a xenon flash lamp or a cathode ray tube, may also be used. On the other hand, a longer exposure time than 1 second can also be used. If necessary, the spectral composition of the light to be used for the exposure can be regulated by using a color filter. A laser ray can also be utilized for the exposure. In addition, the materials can be exposed with a light as emitted from a fluorescent material excited by an electron ray, X-ray, $\gamma$-ray, $\alpha$-ray, etc.

Any known methods and known processing solutions, as described, e.g., in *Research Disclosure,* No. 17643, pp. 28–30 (November, 1978), can be utilized in the photographic treatment of the light-sensitive materials of the present invention. The photographic treatment may be either a photographic treatment for the formation of silver images (black-and-white photographic treatment) or a photographic treatment for the formation of color images (color photographic treatment), in accordance with the objects and usage of the materials. The processing temperature is generally selected from about 18° C. to about 50° C. However, the temperature may be lower than 18° C. or higher than 50° C., if desired.

The color developers which can be used in the development of the materials of the present invention are preferably alkaline aqueous solutions containing an aromatic primary amine type color developing agent as a main component. Suitable color developing agents preferably used are p-phenylenediamine type compounds; typical examples thereof are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and sulfates, hydrochlorides, phosphates and p-toluene-sulfonates thereof, as well as tetraphenylborates and p-(t-octyl)benzenesulfonates thereof.

Aminophenol type derivatives can also be used, including, for example, o-aminophenol, p-aminophenol, 4-amino-2-methylphenol, 2-amino-3-methylphenol, 2-oxy-3-amino-1,4-dimethylbenzene, etc.

In addition, compounds as described in L.F.A. Mason, *Photographic Processing Chemistry,* pp. 226–229, (Focal Press, 1979), U.S. Pat. Nos. 2,193,015 and 2,592,364 and Japanese Patent Application (OPI) No. 64933/73 can also be used. If necessary, two or more kinds of color developing agents can be used in combination.

The processing temperature of the color developer is preferably about 30 to about 50° C., more preferably 33 to 45° C.

Development accelerators may be used in the developer, but benzyl alcohol is preferably not used in view of the prevention of pollution. Instead of the use of benzyl alcohol, various other kinds of compounds can be used. For instance, various kinds of pyrimidium compounds and other cationic compounds, phenosafranines and similar cationic dyes, and natural salts such as thallium nitrate and potassium nitrate, as typically described in, e.g., U.S. Pat. No. 2,648,604, Japanese Patent Publication No. 9503/69 and U.S. Pat. No. 3,171,247 can be used, as well as polyethylene glycol and derivatives thereof, and polythioethers and similar nonionic compounds, as described in Japanese Patent Publication No. 9304/69, U.S. Pat. Nos. 2,533,990, 2,531,832, 2,950,970 and 2,577,127, thioether type compounds as described in U.S. Pat. No. 3,201,242, and the compounds described in Japanese Patent Application (OIP) Nos. 156934/83 and 220344/85.

In a rapid development treatment to be completed in a short period of time, both the means for accelerating development and the techniques for preventing the formation of fog during development are important. Preferred fog inhibitors are alkali metal halides such as potassium bromide, sodium bromide and potassium iodide, as well as organic fog inhibitors. The organic fog inhibitors which can be used herein include nitrogen-containing heterocyclic compounds such as benzotriazole, 6-nitrobenzimidazole, 5-nitroisoidazole, 5-methylbenzotriazole, 5-nitrobenzotriazole, 5-chlorobenzotriazole, 2-thiazolylbenzimidazole, 2-thiazolylmethylbenzimidazole and hydroxyazaindolizine; mercapto-substituted heterocyclic compounds such as 1-phenyl-5-mercaptotetrazole, 2-mercaptobenzimidazole and 2-mercaptobenzothiazole; as well as mercapto-substituted aromatic compounds such as thiosalicylic acid. In particular, halides are especially preferred as the fog inhibitor. The fog inhibitors can also be incorporated in the color photographic light-sensitive materials to be processed (in addition to be added directly to the developer), whereby the fog inhibitor can be dissolved out from the material being processed so as to precipitate in the color developer during the processing of the materials.

In addition, the color developer can contain a pH buffer such as alkali metal carbonates, borates and phosphates; a preservative such as hydroxylamine, triethanolamine, the compounds described in German Patent Application (OLS) No. 2,622,950, sulfites and bisulfites; an organic solvent such as diethylene glycol; a dye-forming coupler; a competing coupler; a nucleating agent such as sodium boronhydride; an auxiliary developing agent such as 1-phenyl-3-pyrazolidone; a tackifier; a chelating agent such as aminopolycarboxylic acids including ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid and the compounds described in Japanese Patent Application (OPI) No. 195845/83, 1-hydroxyethylidene-1,1'-diphosphonic acid, organic phosphonic acids as described in *Research Disclosure,* No. 18170 (May, 1979), aminophosphonic acids including aminotris(methylenephosphonic acid) and ethylenediamine-N,N,N',N'-tetramethylenephosphonic acid, the phosphonocarboxylic acids described in Japanese Patent Application (OPI) Nos. 102726/77, 42730/78, 121127/79, 4024/80, 4025/80, 126241/80, 65955/80 and 65956/80, and *Research Disclosure,* No. 18170 (May, 1979), etc.

The color developer can be divided into two or more developer baths, if necessary, whereupon a color developer replenisher can be replenished into the first bath or into the last bath in the course of the development so that the development time can be reduced and, further, the amount of the replenisher can also be reduced.

The silver halide color photographic materials are, after having been color developed, generally bleached. The bleaching step can be carried out simultaneously with fixation (bleaching-fixation) or, alternatively, separately therefrom. Bleaching agents which can be used are, for example, compounds of polyvalent metals such as iron (III), cobalt (III), chromium (VI) or copper (II), peracids, quinones and nitroso compounds. For instance, ferricyanides, bichromates, organic complexes with iron (III) or cobalt (III) such as complexes of ethylenediaminetetraacetic acid, diethylenetriaminepentaacetic acid, nitril.triacetic acid, 1,3-diamino-2-propanoltetraacetic acid or similar aminopolycarboxylic acids or with citric acid, tartaric acid, malic acid or similar organic acids; persulfates, manganates; and nitrosophenol can be used. In particular, potassium ferricyanide, sodium ethylenediaminetetraacetato ferrate, ammonium ethylenediaminetetraacetato ferrate, ammonium triethylenetetraminepentaacetato ferrate and persulfates are especially preferred. Ethylenediaminetetraacetato ferrate complexes are usable both in an independent bleaching solution and in a combined bleaching-fixation solution.

The bleaching solution and the bleaching-fixation solution may contain, if necessary, various kinds of accelerators. For instance, a bromide ion, an iodide ion, as well as thiourea type compounds as described in U.S. Pat. No. 3,706,561, Japanese Patent Publication Nos. 8506/70 and 26586/74, and Japanese Patent Application (OPI) Nos. 32735/78, 36233/78 and 37016/78; thiol type compounds as described in Japanese Patent Application (OPI) Nos. 124424/78, 95631/78, 57831/78, 32736/78, 65732/78 and 52534/79 and U.S. Pat. No. 3,893,858; heterocyclic compounds as described in Japanese Patent Application (OPI) Nos. 59644/74, 140129/75, 28426/78, 141623/78, 104232/78 and 35727/79; thioether type compounds as described in Japanese Patent Application (OPI) Nos. 20832/77, 25064/80 and 26506/80; quaternary amines as described in Japanese Patent Application (OPI) No. 84430/73; and thiocarbamoyl type compounds as described in Japanese Patent Application (OPI) No. 42349/74 can be used.

Suitable fixing agents include thiosulfates, thiocyanates, thioether type compounds, thioureas and iodides. In particular, thiosulfates are generally used. As the preservative for the bleaching-fixation solution or the fixation solution, sulfites or bisulfites or carbonyl-bisulfite adducts are preferred.

After the bleaching-fixation step or the fixation step, the photographic materials are generally washed with water. In the washing step, various kinds of known compounds can be used fro the purpose of the prevention of precipitation or of the economization of water. For instance, a water softener such as inorganic phosphoric acids, aminopolycarboxylic acids or organic phosphoric acids; a bactericide or fungicide for the prevention of growth of various bacteria, algae or fungi; a hardener such as magnesium salts or aluminum salts; a surfactant for the prevention of drying load or unevenness, etc., can be added as necessary. As the case may be, the compounds described in L.E. West, *Photographic Science and Engineering,* Vol. 9, No. 6 (1965) can be added. In particular, the addition of the chelating agent or fungicide is effective. A multistage countercurrent flow system (for example, comprising 2 to 5 stages) can be used in the washing step for the purpose of the economization of water.

After the washing step or in place thereof, the photographic material may be subjected to multistage countercurrent stabilizing process as described in Japanese Patent Application (OPI) No. 8543/82. The stabilization step requires a countercurrent bath line comprising 2 to 9 baths. Various kinds of compounds are added to the stabilization baths for the stabilization of images. For instance, a film pH regulating buffer (such as borates, metaborates, borax, phosphates, carbonates, potassium hydroxide, sodium hydroxide, aqueous ammonia, monocarboxylic acids, dicarboxylic acids, polycarboxylic acids, etc.) and formalin can be added. In addition, a water softener (such as inorganic phosphoric acids, aminopolycarboxylic acids, organic phosphoric acids, aminopolyphosphonic acids, phosphonocarboxylic acids, etc.), a bactericide (such as Proxel (benzoisothiazoline), isothiazolone, 4-thiazolylbenzimidazole, halogenated phenolbenzotriazoles, etc.), a surfactant, a brightening agent, a hardener, etc., can further be added as needed.

Various kinds of ammonium salts such as ammonium chloride, ammonium nitrate, ammonium sulfate, ammonium phosphate, ammonium sulfate or ammonium thiosulfate can be added as a film pH regulator for regulating the pH value of the film after processing.

The present invention will be explained in greater detail by reference to the following examples, which, however, are not intended to be interpreted as limiting the scope of the present invention. Unless otherwise indicated, all parts, percents, ratios and the like are by weight.

EXAMPLE 1

30 g of lime-treated gelatin was addedto 1,000 cc of distilled water and dissolved at 40° C. and, then, the resulting solution was regulated to have a pH value of 4.0 with sulfuric acid, and 6.5 g of sodium chloride and 0.02 g of N,N'-dimethylethylenethiourea were added thereto and dissolved, and the temperature of the resulting solution was elevated up to 65° C. A solution of 62.5 g of silver nitrate dissolved in 750 cc of distilled water and a solution of 30.6 g of potassium bromide and 6.5 g of sodium chloride dissolved in 500 cc of distilled water were added to the previous solution over the course of 40 minutes, while the temperature was kept at 65° C., and blended. The silver halide particles formed were observed with an electron microscope, indicating the formation of cubic crystals with a length of one edge of 0.36 μm. To the emulsion containing the host crystals were further added a solution containing 62.5 g of silver nitrate dissolved in 500 cc of distilled water and a solution containing 13.1 g of potassium bromide and 15.1 g of sodium chloride dissolved in 300 cc of distilled water over the course of 10 minutes, while the temperature was kept at 60° C., and blended. The silver halide particles formed were observed with an electron microscope, indicating the formation of conjugated crystals, in which the (100) surfaces of the cubic crystals were conjugated with rectangular parallelepiped conjugate crystals comprising (100) surfces (Emulsion (A)).

30 g of lime-treated gelatin was added to 1,000 cc of distilled water and dissolved at 40° C., and then the resulting solution was regulated to have a pH value of 4.0 with sulfuric acid, and 6.5 g of sodium chloride and 0.02 g of N,N'-dimethylethylenethiourea were added thereto and dissolved, and thereafter the temperature of the resulting solution was elevated up to 60° C. A solution containing 6.5 g of silver nitrate dissolved in 750 cc of distilled water and a solution containing 21.9 g of potassium bromide and 10.8 g of sodium chloride dissolved in 500 cc of distilled water were added to the previous solution over the course of 40 minutes, while the temperature was kept at 60° C., and blended. The silver halide particles formed were observed with an electron microscope, indicating the formation of cubic crystals with a length of one edge of 0.36 μm. To the emulsion containing the host crystals were further added a solution containing 62.5 g of silver nitrate dissolved in 500 cc of distilled water and a solution containing 21.9 g of potassium bromide and 10.8 g of sodium chloride dissolved in 300 cc of distilled water over the course of 10 minutes, while the temperature was kept at 60° C., and blended. The silver halide particles formed were observed with an electron microscope, indicating the formation of cubic particles with a length of one edge of 0.45 μm (Emulsion (B)).

30 g of lime-treated gelatin was added to 1,000 cc of distilled water and dissolved at 40° C., and then the resulting solution was regulated to have a pH value of 4.0 with sulfuric acid, and 6.5 g of sodium chloride and 0.02 g of N,N'-dimethylethylenethiourea were added thereto and dissolved, and the temperature of the resulting solution was elevated up to 55° C. A solution containing 62.5 g of silver nitrate dissolved in 750 cc of distilled water and a solution containing 13.1 g of potassium bromide and 15.1 g of sodium chloride dissolved in 500 cc of distilled water were added to the previous solution over the course of 40 minutes, while the temperature was kept at 55° C. The silver halide particles formed were observed with an electron microscope, indicating the formation of cubic crystals having a length of one edge of 0.36 μm. To the emulsion containing the host crystals were further added a solution containing 62.5 g of silver nitrate dissolved in 500 cc of distilled water and a solution containing 30.6 g of potassium bromide and 6.5 g of sodium chloride dissolved in 300 cc of distilled water over the course of 10 minutes, while the temperature was kept at 65° C., and blended. The silver halide particles formed were observed with an electron microscope, indicating the formation of cubic particles with an edge of about 0.45 μm which were somewhat expanded in the corners and had steps in the (100) surfaces (Emulsion C)).

A host crystal-containing emulsion was prepared in the same manner as described above for Emulsion (A)). Prior to the formation of the conjugated crystals, 0.10 g, 0.16 g or 0.32 g, respectively, of 1-(m-methylureidophenyl)-5-mercaptotetrazole was added to the emulsion and the same silver nitrate solution and halide solution as used in the formation of the second silver halide crystals in Emulsion (A) described above were added thereto. The emulsions obtained were designated Emulsion (D), Emulsion (E) and Emulsion (F), respectively.

Next, the host crystal-containing emulsion was prepared in the same manner as described above for Emulsion (B). Prior to the formation of the second or conjugate crystals, 0.10 g, 0.16 g or 0.32 g, respectively, of 1-(m-methylureidophenyl)-5-mercaptotetrazole was added to the emulsion and the same silver nitrate solution and halide solution as used in the formation of the second silver halide crystals in Emulsion (B) described above were added thereto. The emulsions obtained were designated Emulsion (G), Emulsion (H) and Emulsion (I), respectively.

Further, the host crystal-containing emulsion was prepared in the same manner as described above for Emulsion (C). Prior to the formation of the second or conjugate crystals, 0.10 g, 0.16 g or 0.32 g, respectively, of 1-(m-methylureidophenyl)-5-mercaptotetrazole was added to the emulsion and the same silver nitrate solution and halide solution as used in the formation of the second silver halide crystals in Emulsion (C) described above were added thereto. The emulsions obtained were designated Emulsion (J), Emulsion (K) and Emulsion (L), respectively.

Figure 4:
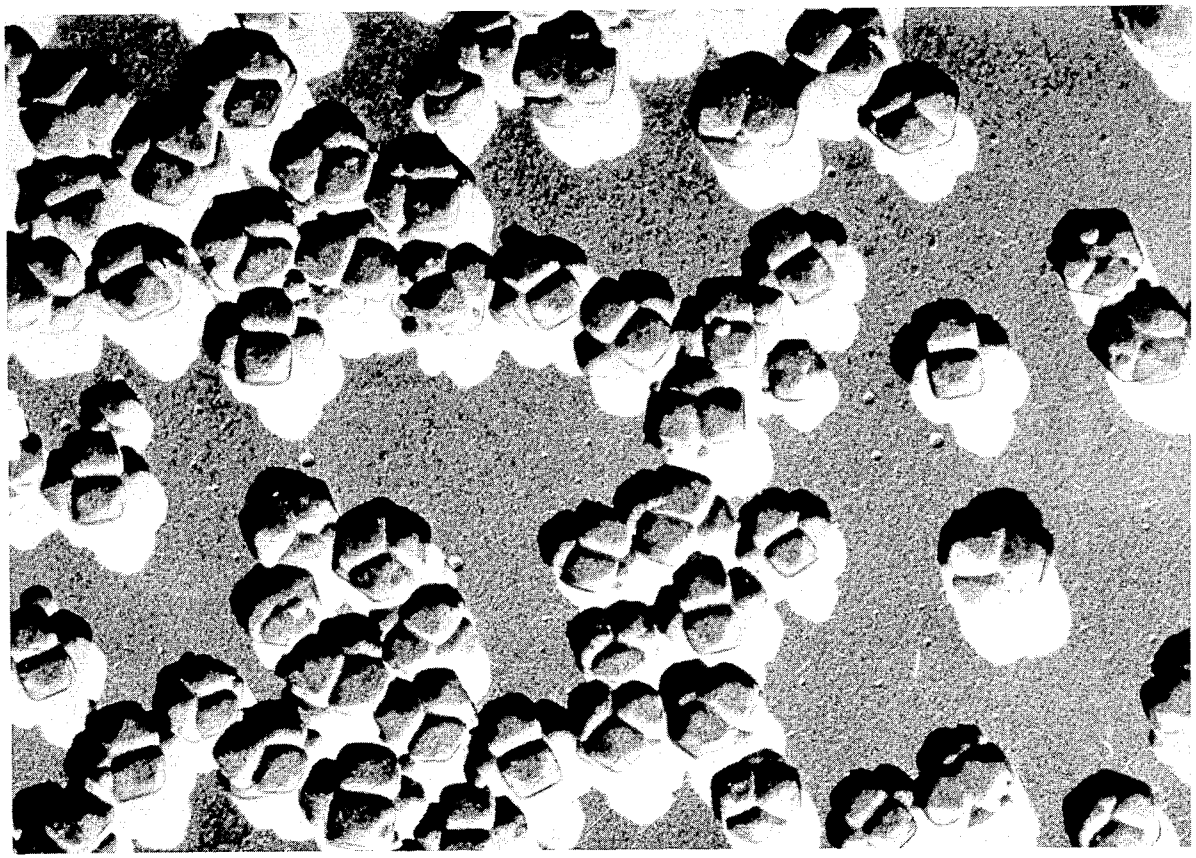
FIGS. 4 to 22 each shows an electron microscopic photograph (×30,000) of conjugated silver chlorobromide particles in the emulsions (D), (E), (F), (J), (K), (L), (M), (N), (O), (P), (Q), (R), (S), (T), (U), (X), (Z), (B-1) and (B-2) described hereinafter.

The crystal particles were Emulsion (D) were observed with an electron microscope, indicating the formation of conjugated crystals, in which the (100) surfaces of the host crystals were conjugated with the second conjugate crystals which had (100) surfaces surrounded by (110) surfaces (FIG. 4).

Figure 5:
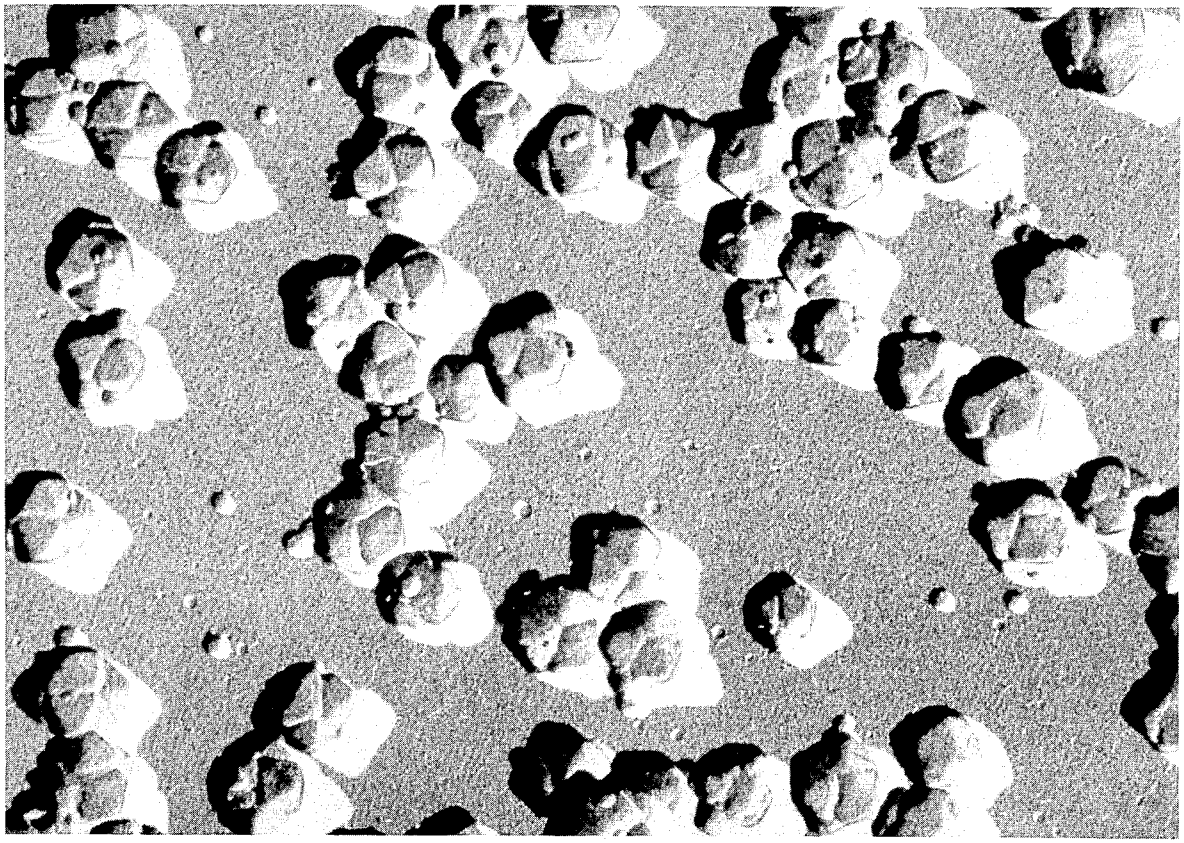

The crystal particles of Emulsion (E) were observed with an electron microscope, indicating the formation of conjugate crystals, in which the (100) surfaces of the host crystals were conjugated with the second conjugate crystals surrounded by (110) surfaces (FIG. 5).

Figure 6:
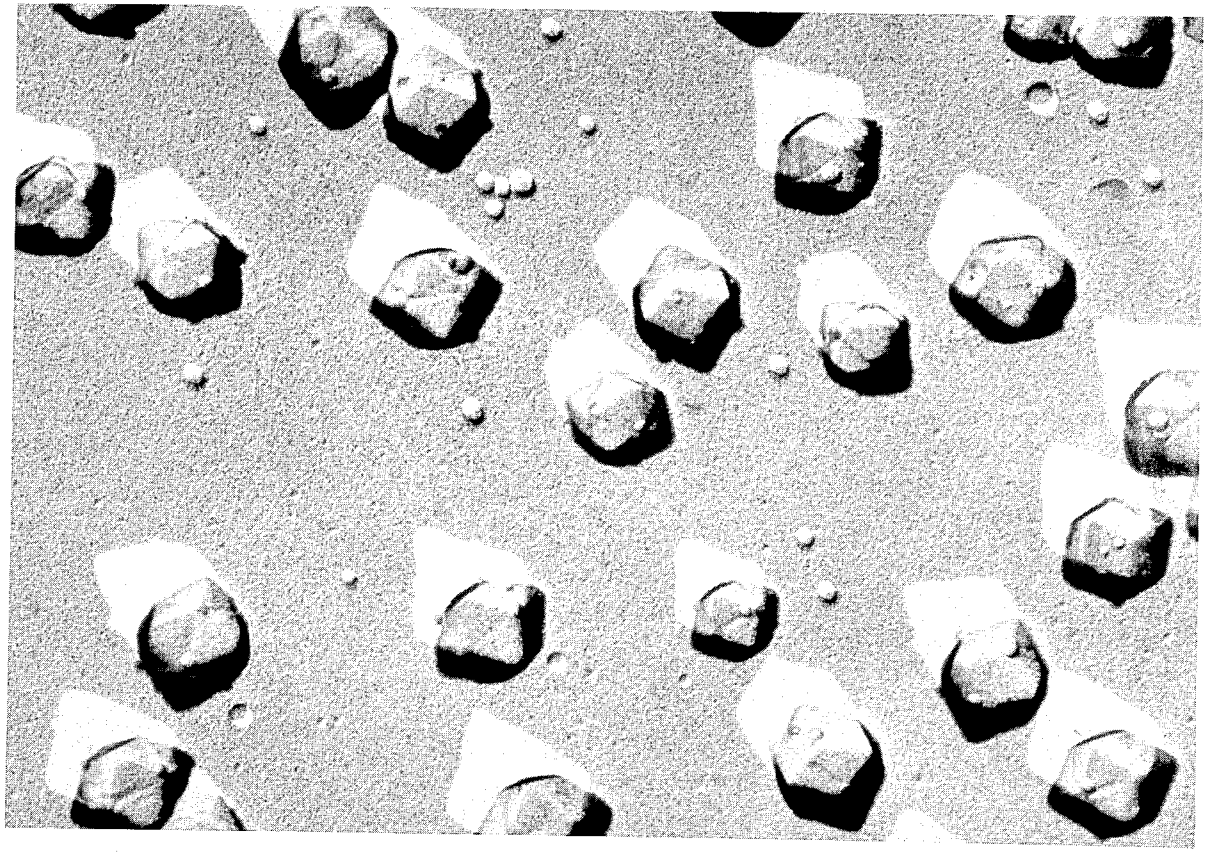

The crystal particles of Emulsion (F) were observed with an electron microscope, indicating the formation of conjugated crystals, in which the (100) surfaces of the host crystals were conjugated with the second conjugate crystals surrounded by four (110) surfaces and the overall appearance of each conjugated crystal particle was confirmed to have a shape like a rhombic dodecahedron. However, the conjugated crystal particles thus-formed were different from general or conventional rhombic dodecahedral crystals in that the edge parts (that is, the parts corresponding to the (110) surfaces) of the host cubic crystals existing in the conjugated particles were confirmed to have formed thin grooves (dividing the rhombic surfaces of the rhombic dodecahedral crystals into two parts (FIG. 6).

The crystal particles of Emulsion (G) were observed with an electron microscope, indicating the formation of nearly cubic crystals in which the edge portions of the cubic crystals were confirmed to be somewhat rounded.

The crystal particles of Emulsion (H) were observed with an electron microscope, indicating the formation of particles in which the edge portions of the cubic crystals were confirmed to be rounded to fairly reveal the (110) surfaces.

The crystal particles of Emulsin (I) were observed with an electron microscope, indicating the formation of no cubic crystals but the formation of complete rhombic dodecahedral particles.

Figure 7:
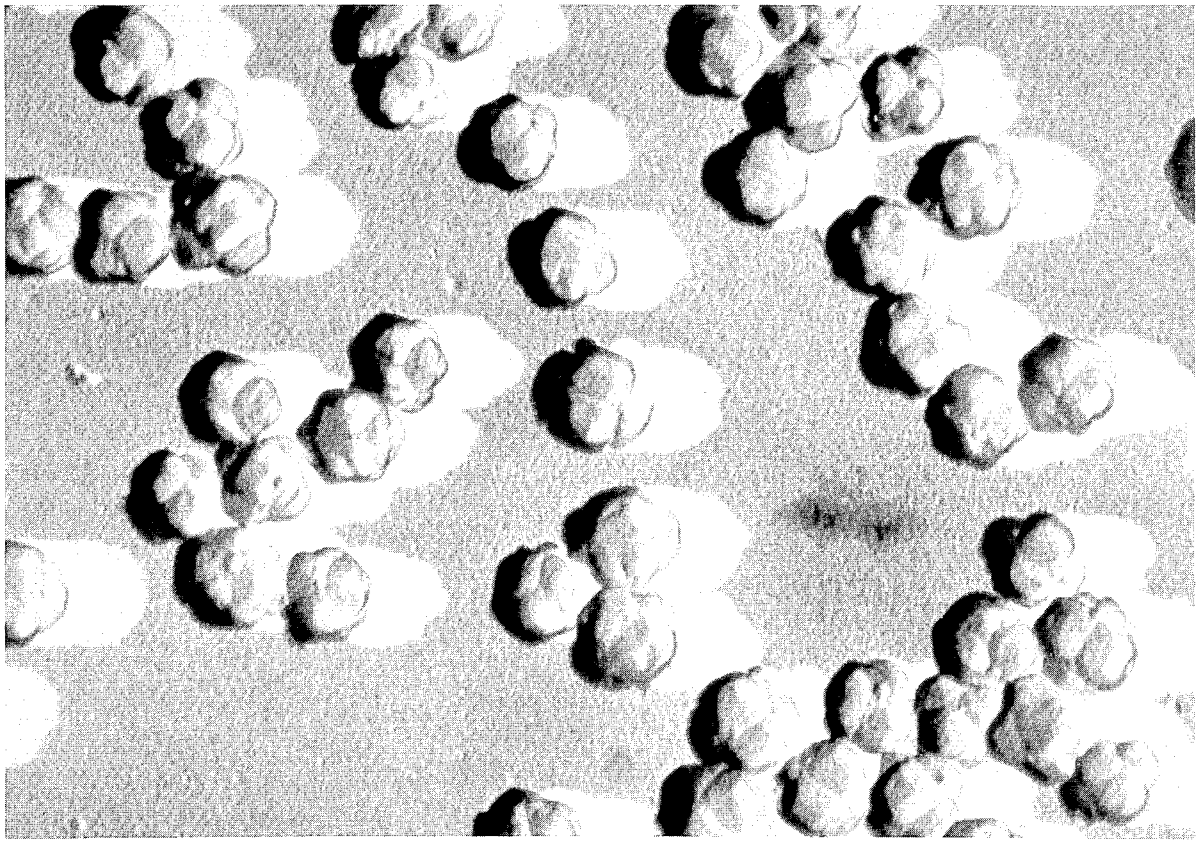

The crystal particles of Emulsion (J) were observed in the same manner, indicating the formation of conjugated crystals, in which the (100) surfaces of the cubic host crystals were conjugated with the second conjugate crystals which had (100) surfaces surrounded by (110) surfaces (FIG. 7).

Figure 8:
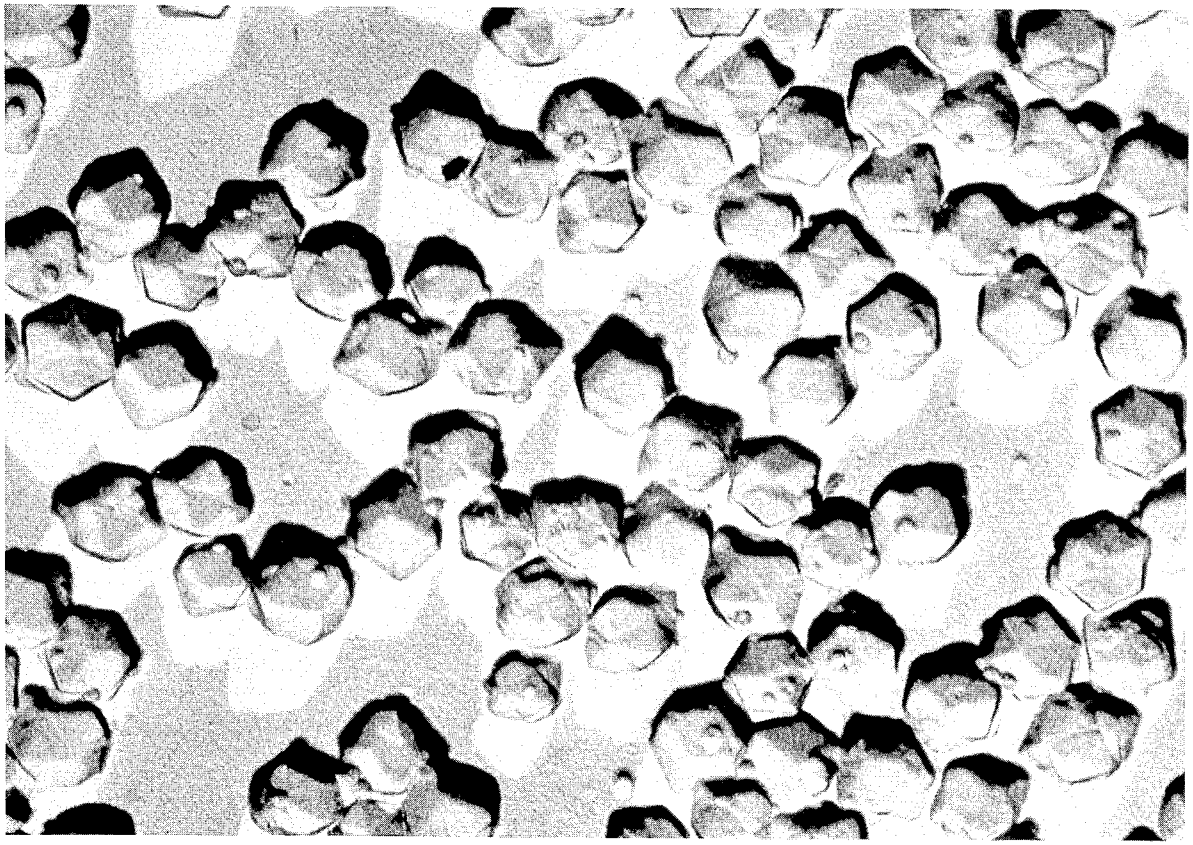

The crystal particles of Emulsion (K) were observed in the same manner, indicating the formation of conjugated crystals, in which the (100) surfaces of the cubic host crystals were conjugated with the second conjugate crystals surrounded by (110) surfaces (FIG. 8).

Figure 9:
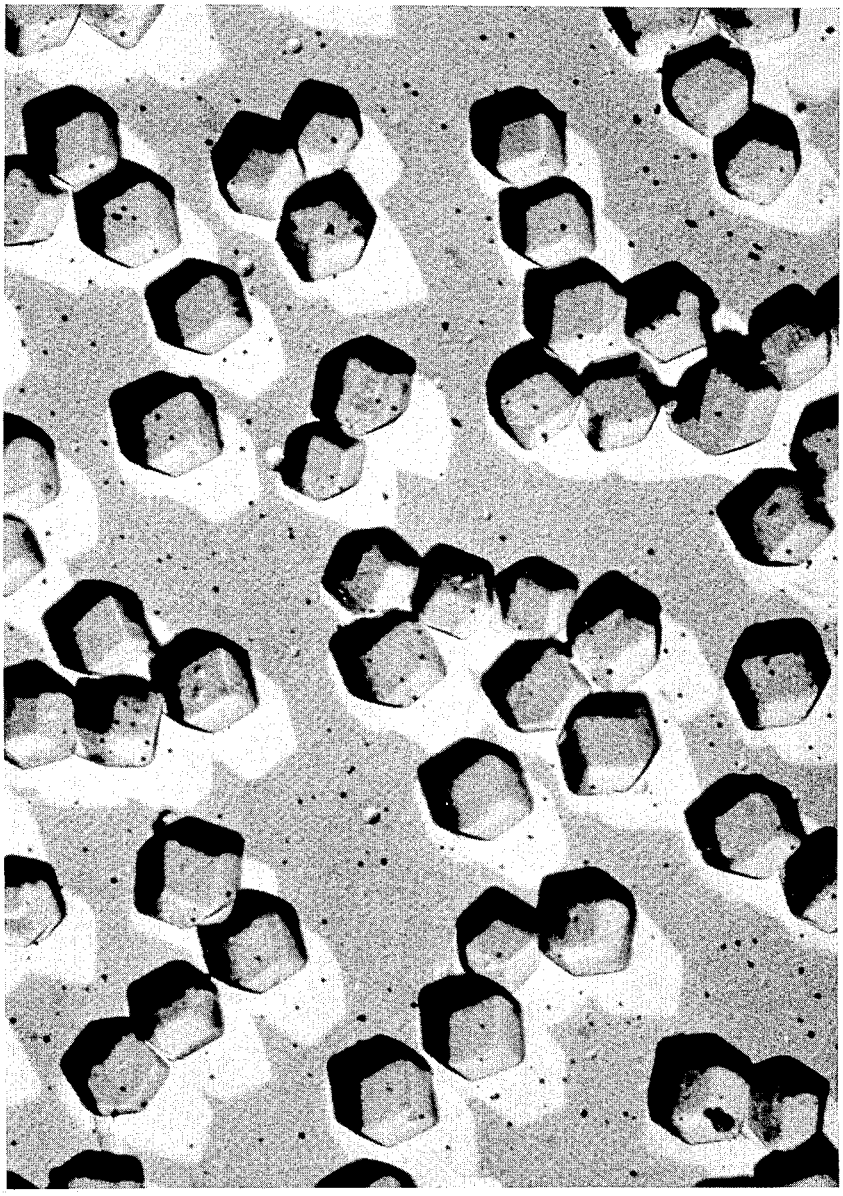

The crystal particles of Emulsion (L) were observed in the same manner, indicating the formation of conjugated crystals, in which the (100) surfaces of the cubic host crystals were conjugated with the second conjugate crystals surrounded by four (110) surfaces and the overall appearance of each conjugated crystal particle was confirmed to have a shape of a rhombic dodecahedron. However, these crystal particles were also confirmed, like those in Emulsion (F), to have thin grooves dividing each of the rhombic surfaces into two parts (FIG. 9).

Summarizing the above, it is concluded that Emulsions (D), (E), (F), (J), (K) and (L) are novel emulsions within the scope of the present invention, while Emulsions (A), (B), (C), (G), (H) and (I) fall outside the scope of the present invention.

Table 1 below summarizes the properties of the emulsions formed as described above.

TABLE 1

| Emulsion | First (host) Crystals* (mol %) | Second (conjugate) Crystals* (mol %) | Shape of Resulting Conjugate Crystal | Remarks |
|---|---|---|---|---|
| A | 70 | 30 | 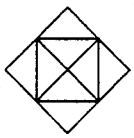 | Comparison |

TABLE 1-continued
| Emulsion | First (host) Crystals* (mol %) | Second (conjugate) Crystals* (mol %) | Shape of Resulting Conjugate Crystal | Remarks |
|---|---|---|---|---|
| B | 50 | 50 | 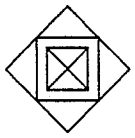 | Comparison |
| C | 30 | 70 | 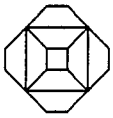 | Comparison |
| D | 70 | 30 | 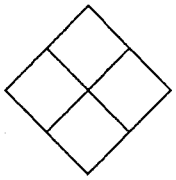 | Comparison |
| E | 70 | 30 | 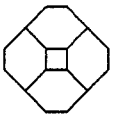 | Comparison |
| F | 70 | 30 | 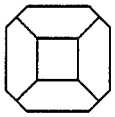 | Comparison |
| G | 50 | 50 | 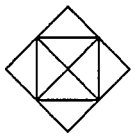 | Comparison |
| H | 50 | 50 | 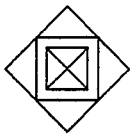 | Comparison |
| I | 50 | 50 | 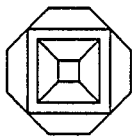 | Comparison |
| J | 30 | 70 | 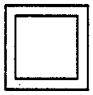 | Comparison |
| K | 30 | 70 | 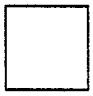 | Comparison |

TABLE 1-continued

| Emulsion | First (host) Crystals* (mol %) | Second (conjugate) Crystals* (mol %) | Shape of Resulting Conjugate Crystal | Remarks |
|---|---|---|---|---|
| L | 30 | 70 | | Comparison |

*Content of silver bromide in each crystal.

EXAMPLE 2

Figure 10:
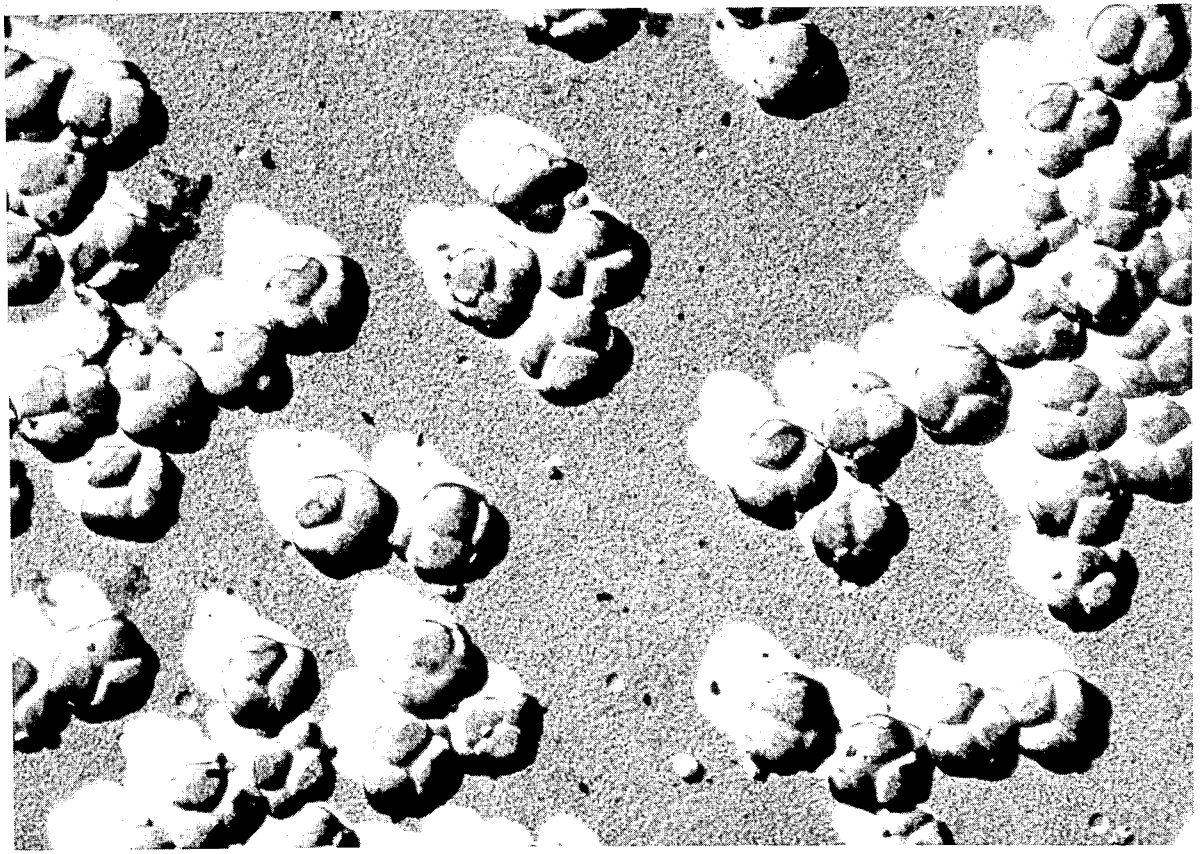

In the same manner as in the preparation of Emulsion (E) in Example 1, with the exception that 1-(m-methylureidophenyl)-5-mercaptotetrazole was replaced by the same molar amount of 1-phenyl-5-mercaptotetrazole, Emulsion (M) was prepared. Emulsion (M) was confirmed, by observation with an electron microscope, to have the same type of conjugated particles as those in Emulsion (D) described above (FIG. 10).

Figure 11:
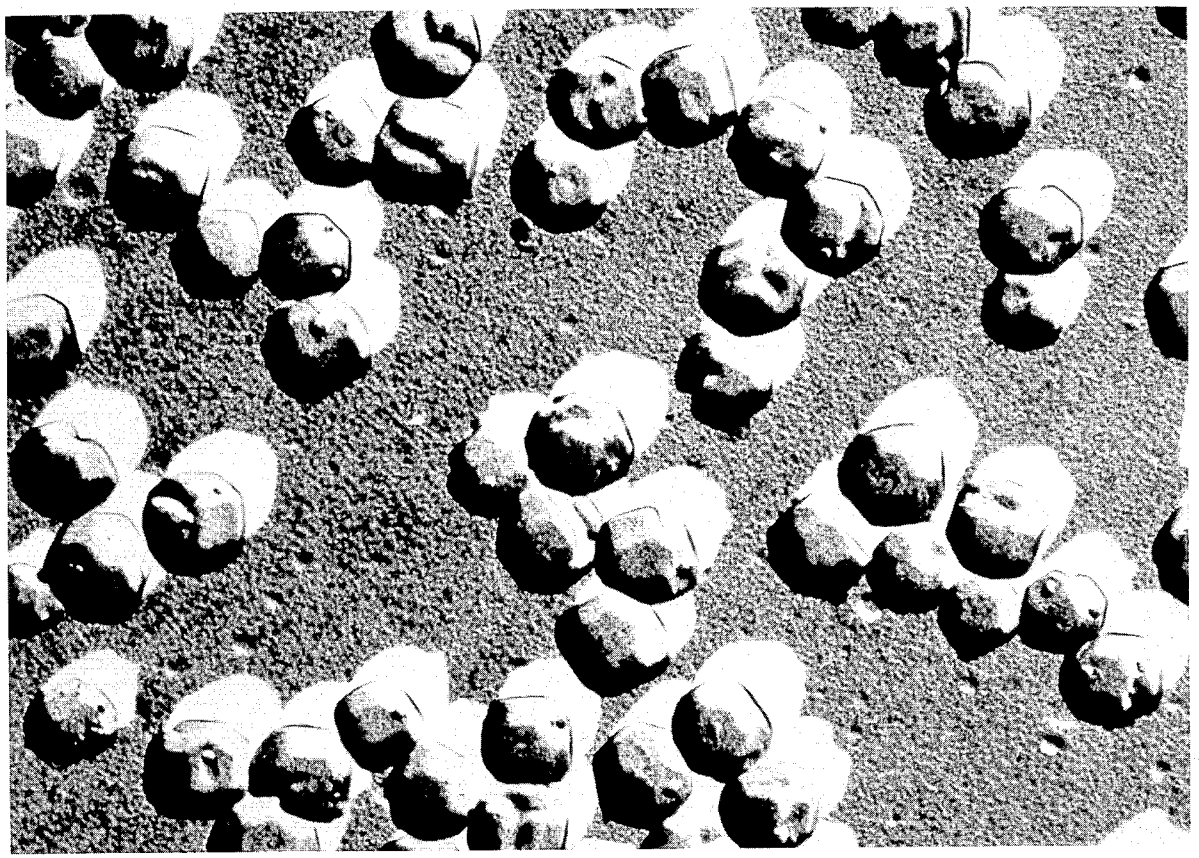

In the same manner as in the preparation of Emulsion (F) in Example 1, with the exception that 1-(m-methylureidophenyl)-5-mercaptotetrazole was replaced by the same molar amount of 2-amino-5-mercapto-1,3,4-thiadiazole, Emulsion (N) was prepared. Emulsion (N) was confirmed, by observation with an electron microscope, to have the same type conjugated particles as those in Emulsion (D) described above (FIG. 11).

Figure 12:
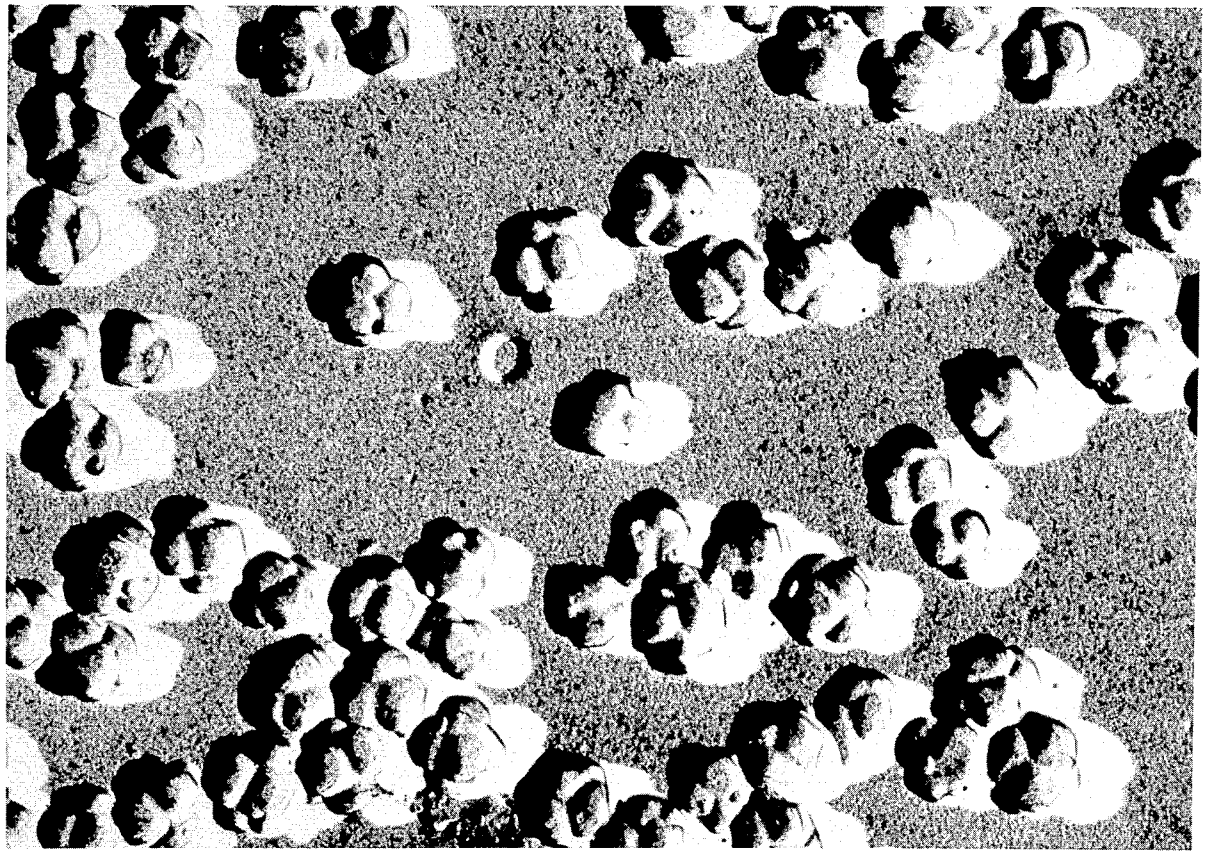

In the same manner as in the preparation of Emulsion (F) in Example 1, with the exception that 1-(m-methylureidophenyl)-5-mercaptotetrazole was replaced by the same molar amount of 2-methylthio-5-mercapto-1,3,4-thiadiazole, Emulsion (O) was prepared. Emulsion (O) was confirmed, by observation with an electron microscope, to have the same type of conjugated particles as those in Emulsion (F) described above (FIG. 12).

Figure 13:
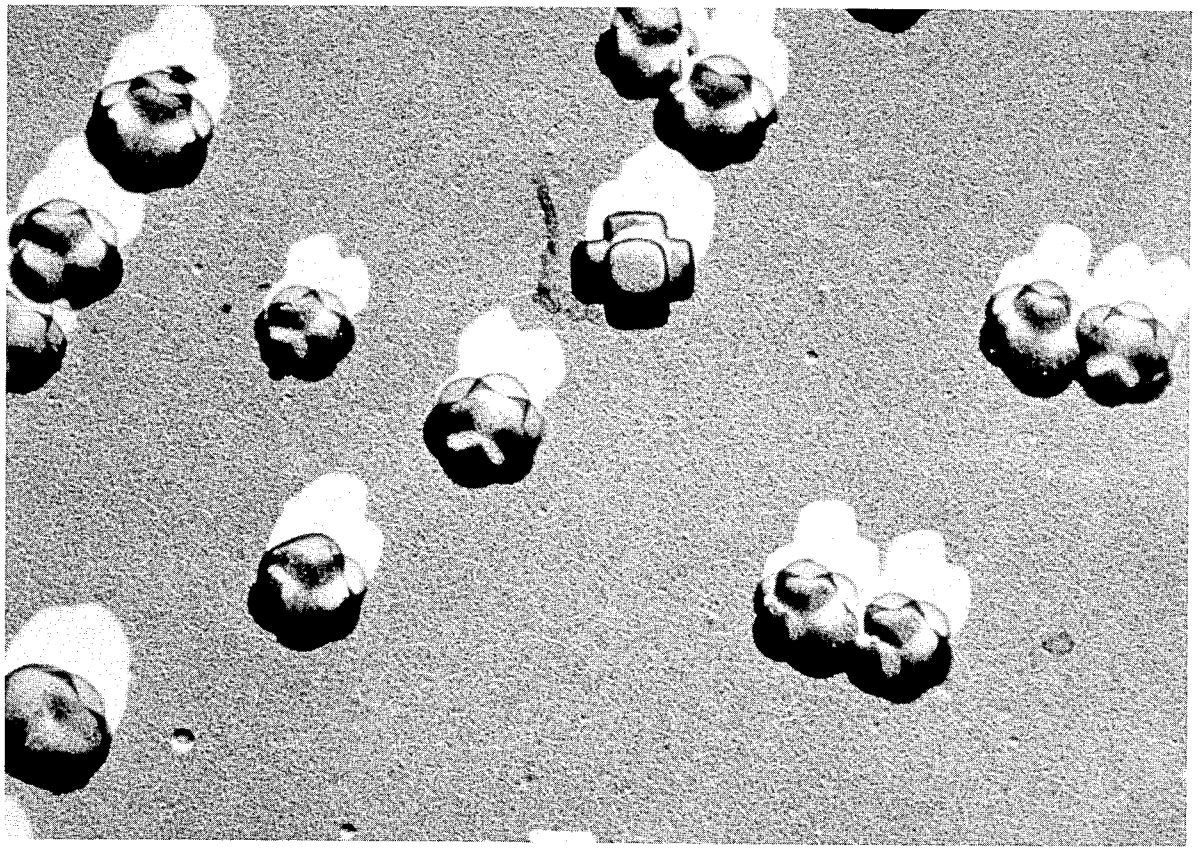

In the same manner as in the preparation of Emulsion (E) in Example 1, with the exception that 1-(m-methylureidophenyl)-5-mercaptotetrazole was replaced by 0.6 g of 4-hydroxy-6-methyl-1,3,3a,7-tetraazaindene, Emulsion (P) was prepared. Emulsion (P) was confirmed, by observation with an electron microscope, to have conjugated particles which were an intermediate shape as compared to the particles in Emulsion (D) and those in Emulsion (E) described above (FIG. 13).

Figure 14:
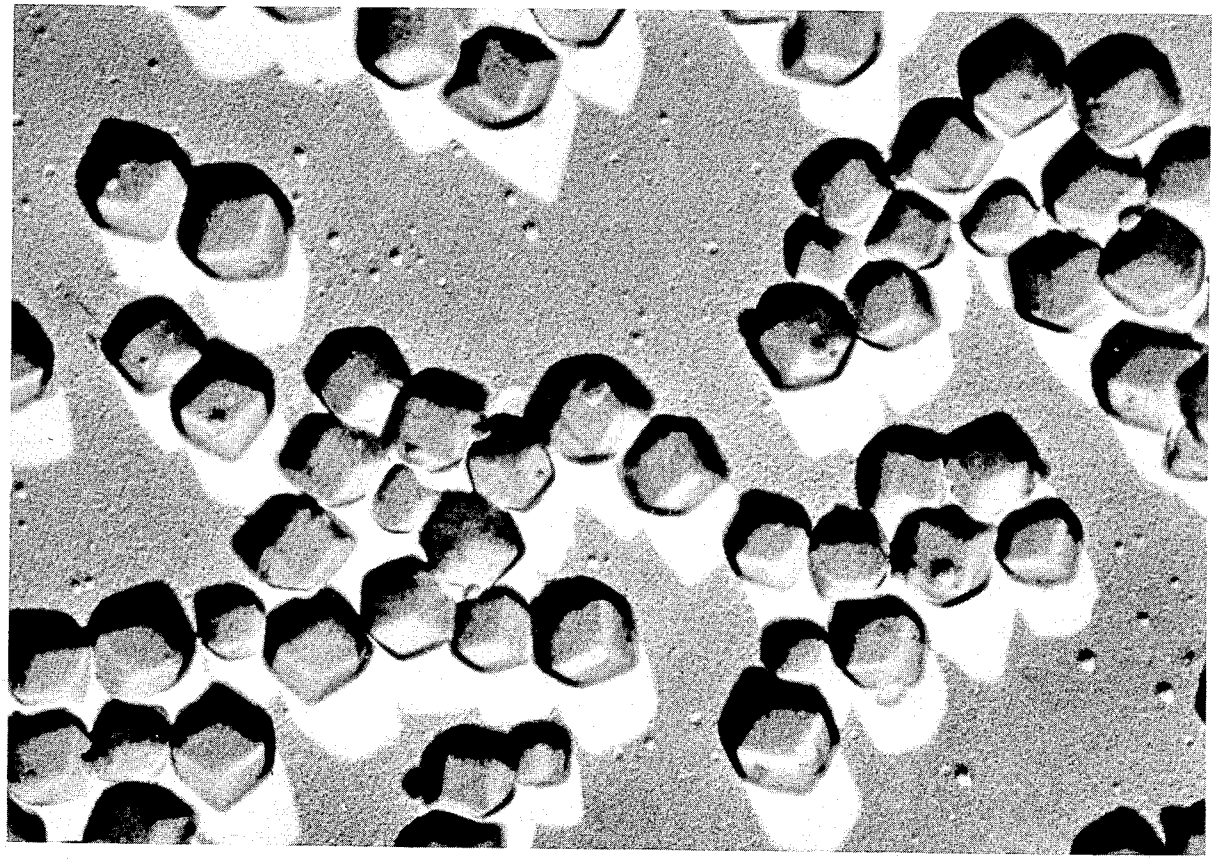

In the same manner as in the preparation of Emulsion (E) in Example 1, with the exception that 1-(m-methylureidophenyl)-5-mercaptotetrazole was replaced by 0.4 g of 4-hydroxy-5,6-trimethylene-1,3,3a,7-tetraazaidene, Emulsion (Q) was prepared. Emulsion (Q) was confirmed, by observation with an electron microscope, to have the same type of conjugated particles as those in Emulsion (F) described above (FIG. 14).

Figure 15:
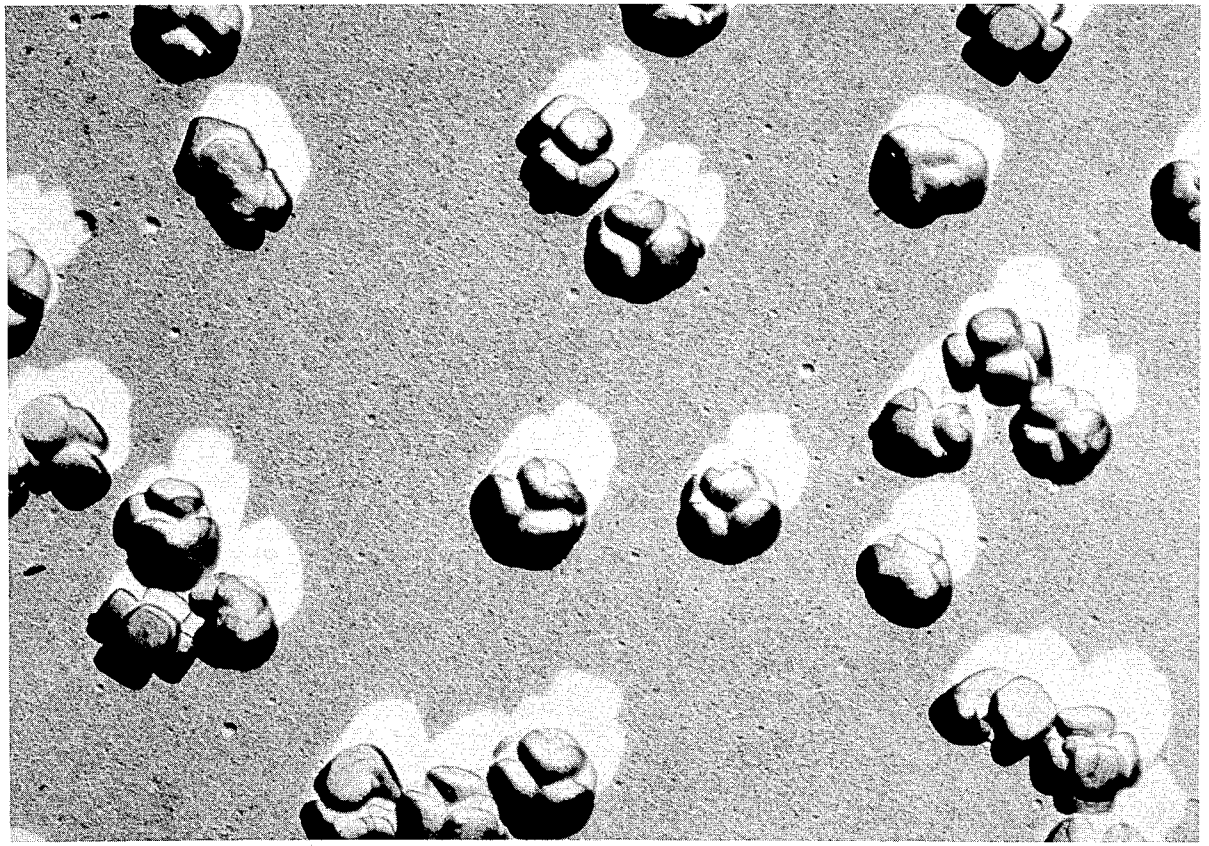

In the same manner as in the preparation of Emulsion (E) in Example 1, with the exception that 1-(m-methylureidophenyl)-5-mercaptotetrazole was replaced by 0.36 g of 3,3'-diethyl-9,9'-(2,2-dimethyl-1,3-propano)thiadicarbocyanine iodide, Emulsion (R) was prepared. Emulsion (R) was confirmed, by observation with an electron microscope, to have the same type of conjugated particles as those in Emulsion (D) described above (FIG. 15).

EXAMPLE 3

30 g of lime-treated gelatin was added to 1,000 cc of distilled water and dissolved at 40° C., and then the resulting solution was regulated to have a pH value of 4.0 with sulfuric acid, and 6.5 g of sodium chloride and 0.02 g of N,N'-dimethylethylenethiourea were added thereto and dissolved and the temperature of the resulting solution was elevated up to 65° C. A solution containing 35 g of silver nitrate dissolved in 420 cc of distilled water and a solution containing 7.4 g of potassium bromide and 8.4 g of sodium chloride dissolved in 280 cc of distilled water were added to the previous solution over the course of 22 minutes and 30 seconds, while the temperature was kept at 65° C., and dissolved. The silver halide particles formed were observed with an electron microscope, indicating the formation of cubic crystals with a length of one edge of 0.29 μm. To this emulsion containing the host crystals were further added a solution containing 23 g of silver nitrate dissolved in 160 cc of distilled water and a solution containing 9.8 g of potassium bromide and 2.1 g of sodium chloride dissolved in 300 cc of distilled water over the course of 3 minutes, while the temperature was kept at 67.5° C., and blended.

Figure 16:
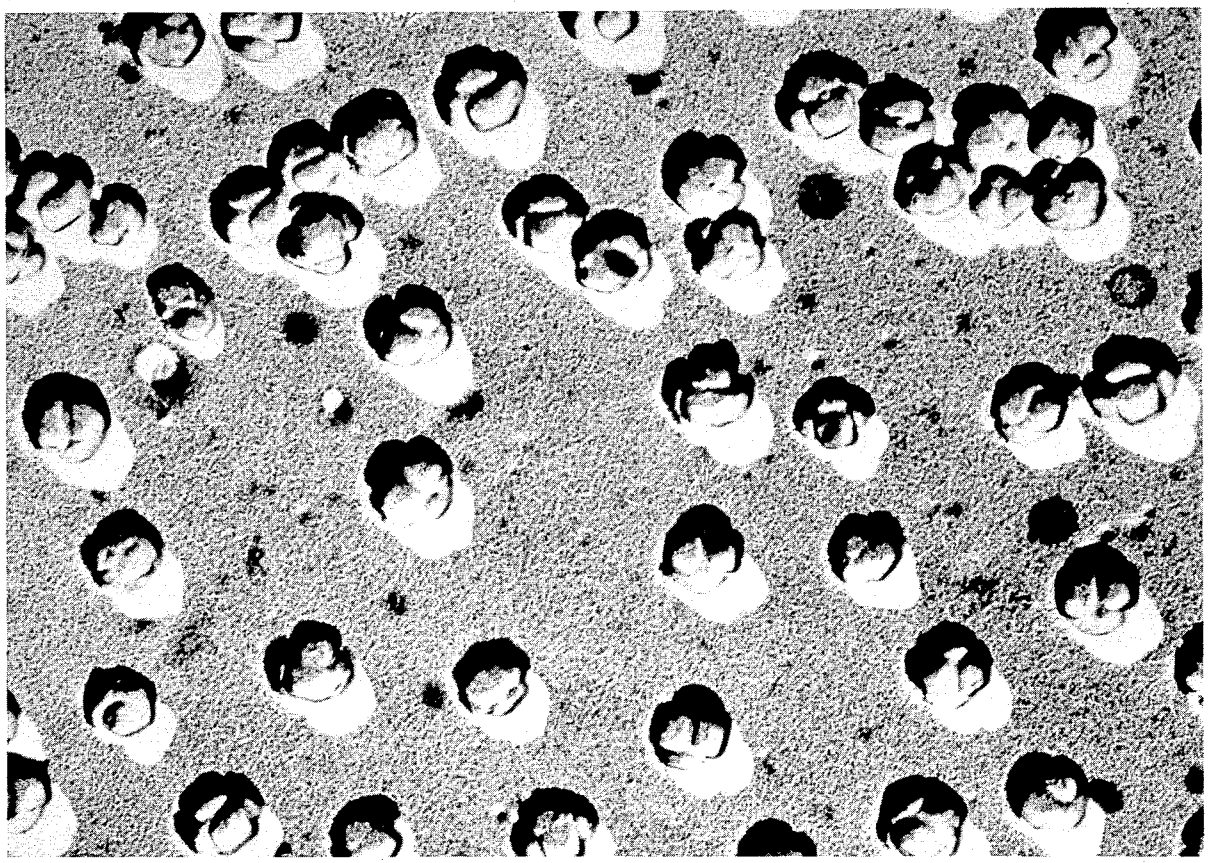

Prior to the addition of the silver salt aqueous solution and the soluble halide aqueous solution in the second stage, 0.1 g of 1-(m-methylureidophenyl)-5-mercaptotetrazole was added, to obtain Emulsion (S). Emulsion (S) was confirmed, by observation with an electron microscope, to have the same type of conjugated particles as those in Emulsion (J) described above (FIG. 16).

Figure 17:
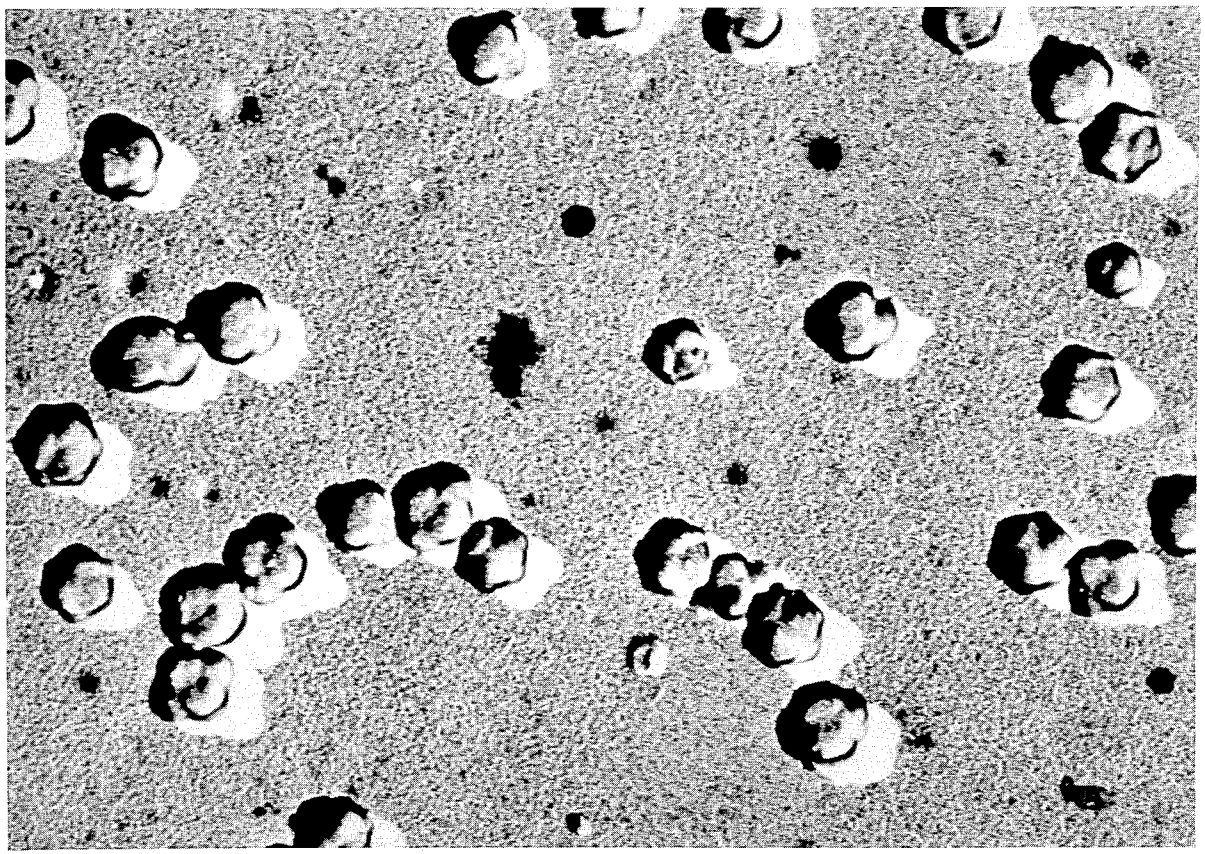

In the same manner as in the preparation of Emulsion (S), with the exception that 1-(m-methylureidophenyl)-5-mercaptotetrazole was replaced by the same molar amount of 1-phenyl-5-mercaptotetrazole, Emulsion (T) was prepared. Emulsion (T) was confirmed, by observation with an electron microscope, to have the same type of conjugated particles as those in Emulsion (J) described above (FIG. 17).

Figure 18:
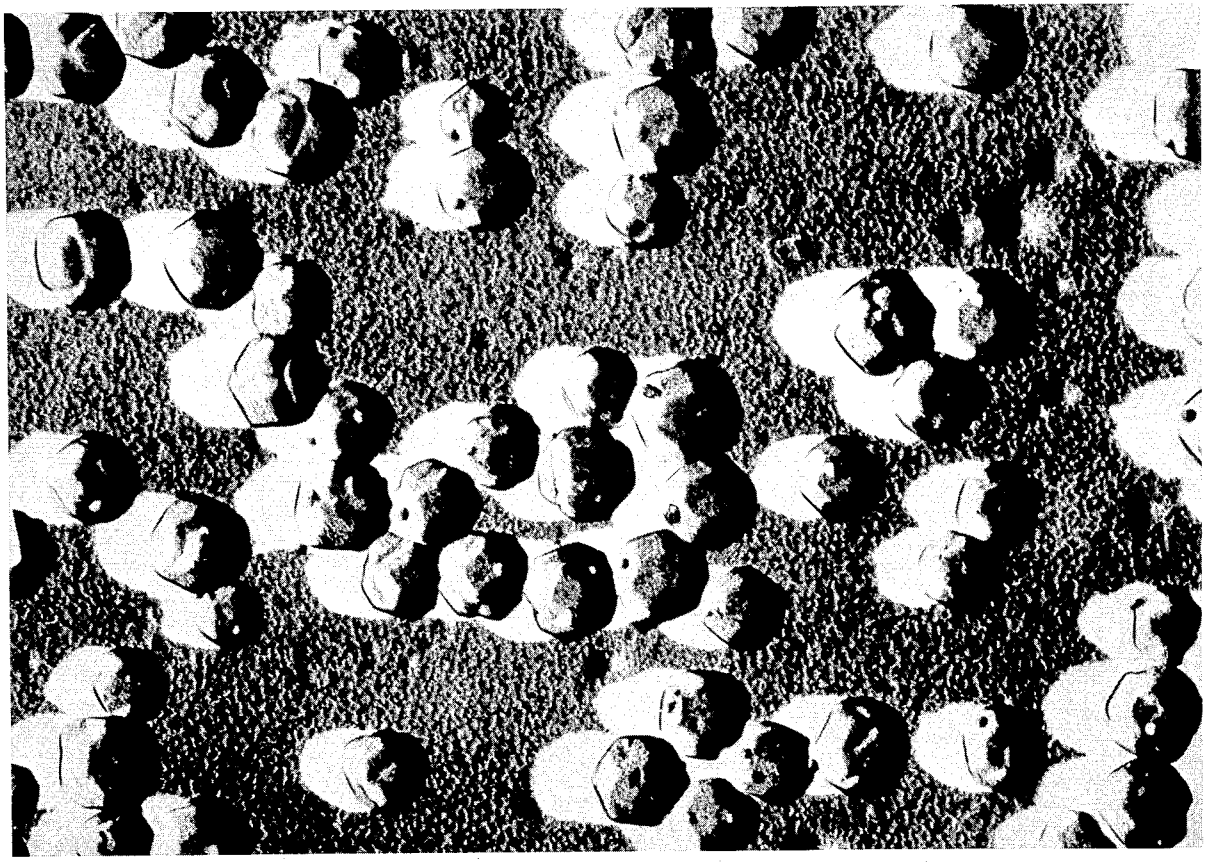

In the same manner as in the preparation of Emulsion (S), with the exceptionthat 1-(m-methylureidophenyl)-5-mercaptotetrazole was replaced by the same molar amount of 2-amino-5-mercapto-1,3,4-thidiazole, Emulsion (U) was prepared. Emulsion (U) was confirmed, by observation with an electron microscope, to have the same type of conjugated particles as those in Emulsion (J) described above (FIG. 18).

In the same manner as in the preparation of Emulsion (S), with the exception that 1-(m-methylureidophenyl)-5-mercaptotetrazole was replaced by twice the molar amount of 2-methylthio-5-mercapto-1,3,4-thiadiazole, Emulsion (V) was prepared. Emulsion (V) was confirmed, by observation with an electron microscope, to have the same type of conjugated particles as those in Emulsion (J) described above.

In the same manner as in the preparation of Emulsion (S), with the exception that 1-(me-methylureidophenyl)-5-mercaptotetrazole was replaced by 0.45 g of 4-hydroxy-6-methyl-1,3,3a,7-tetraazindene, Emulsion (W) was prepared. Emulsion (W) was confirmed, by observation with an electron microscope, to have conjugated particles which were of an intermediate shape as compared with the particles in Emulsion (J) and those in Emulsion (K) described above.

Figure 19:
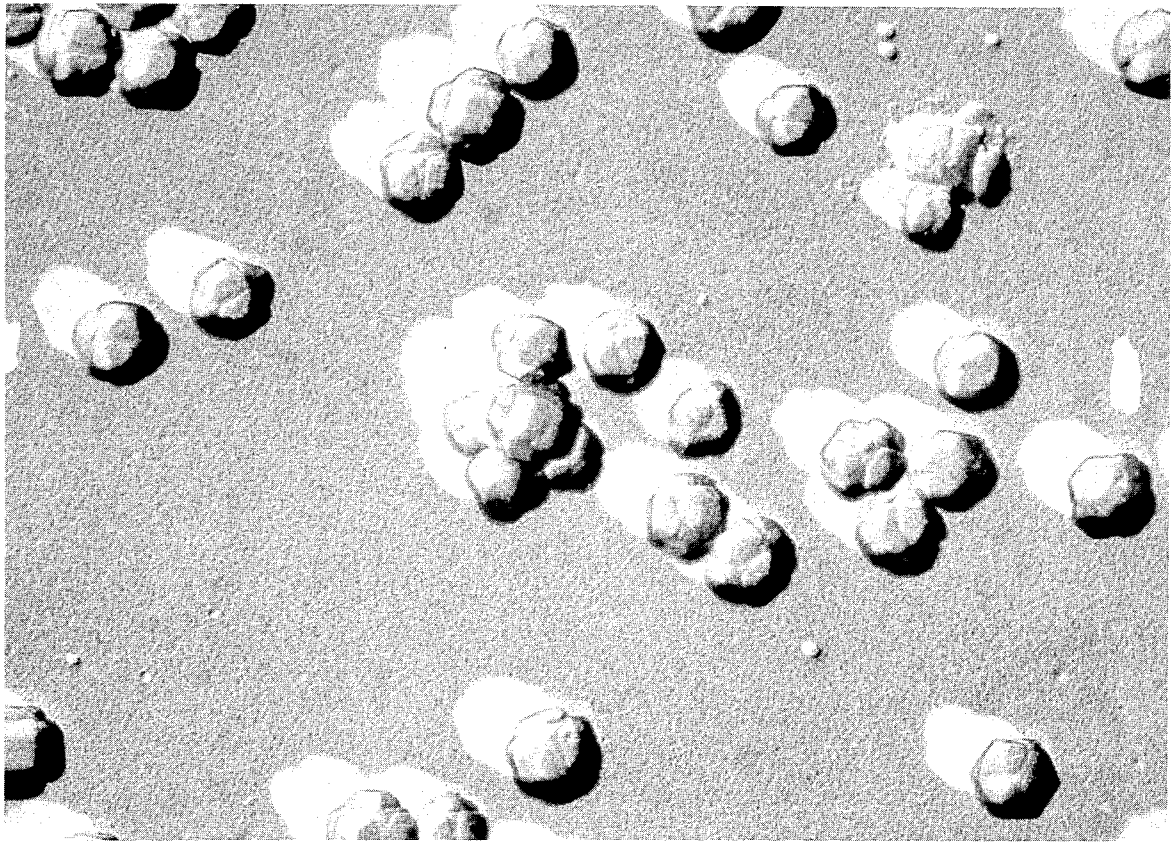

In the same manner as in the preparation of Emulsion (S), with the exception that 1-(m-methylureidophenyl)-5-mercaptotetrazole was replaced by 0.3 g of 4-hydroxy-5,6-trimethylene-1,3,3a,7-tetraazaindene, Emulsion (X) was prepared. Emulsion (X) was confirmed, by observation with an electron microscope, to have the same type of conjugated particles as those in Emulsion (K) described above (FIG. 19).

In the same manner as in the preparation of Emulsion (S), with the exception that 1-(m-methylureidophenyl)-5-mercaptotetrazole was replaced by 0.27 g of 3,3'-diethyl-9,9'-(2,2-dimethyl-1,3-propano)thiadicarbocyanine iodide, Emulsion (Y) was prepared. Emulsion (Y) was confirmed, by observation with an electron microscope, to have the same type of conjugated particles as those in Emulsion (J) described above.

EXAMPLE 4

Figure 20:
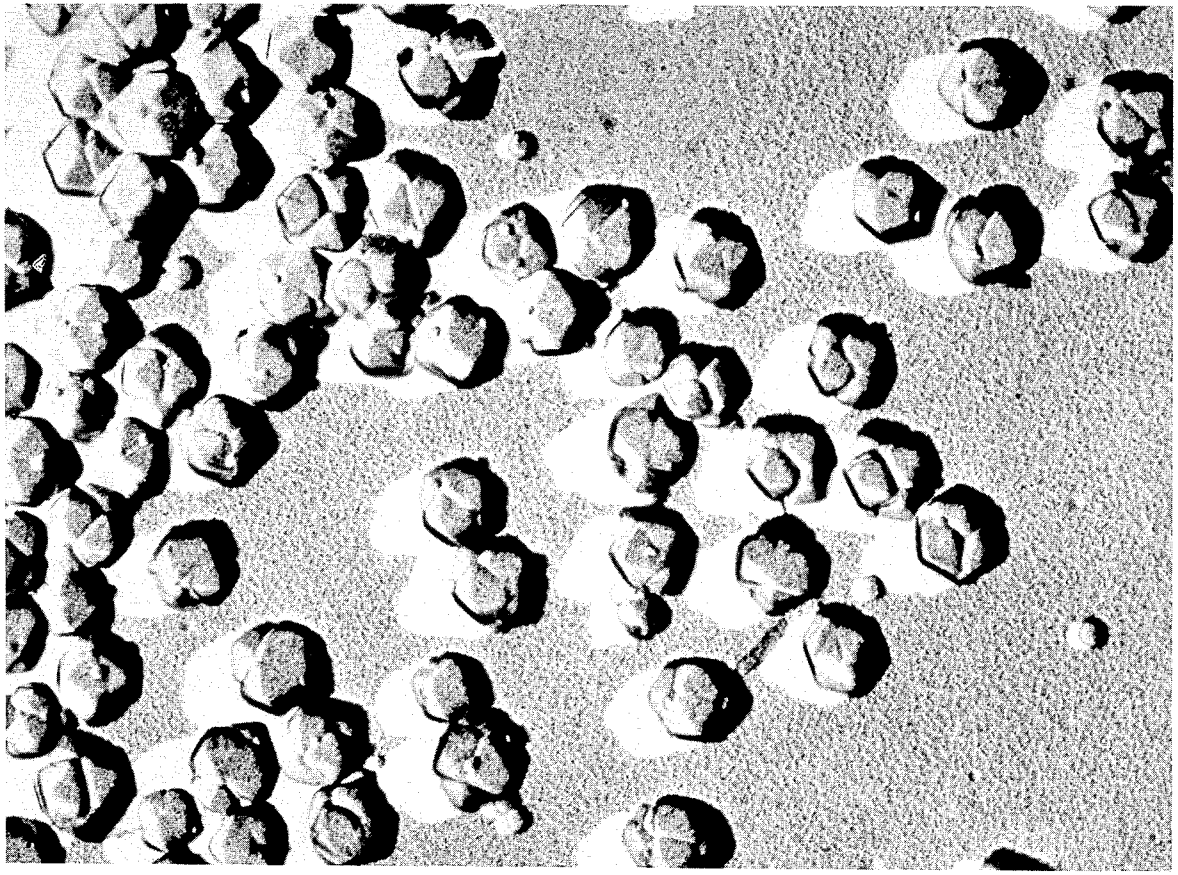

30 g of lime-treated gelatin was added to 1,000 cc of distilled water and dissolved at 40° C. with sulfuric acid, and 6.5 g of sodium chloride and 0.02 g of N,N'-dimethylethylenethiourea were added thereto and dissolved, and the temperature of the resulting solution was elevated up to 65° C. A solution containing 35 g of silver nitrate dissolved in 420 cc of distilled water and a solution containing 17.2 g of potassium bromide and 3.6 g of sodium chloride dissolved in 280 cc of distilled water were added to the previous solution over the course of 22 minutes and 30 seconds, while the temperature was kept at 65° C., and blended. The silver halide particles formed were observed with an electron microscope, indicating the formation of cubic crystals with a length of one edge of 0.29 μm. To the emulsion containing these host crystals was added 0.16 g of 1-(m-methylureidophenyl)-5-mercaptotetrazole, and then a solution containing 58 g of silver nitrate dissolved in 465 cc of distilled water and a solution of 12.2 g of potassium bromide and 14.0 g of sodium chloride dissolved in 275 cc of distilled water were further added thereto over the course of 9 minutes and 20 seconds, while the temperature was kept at 60° C., and blended. The emulsion obtained was designated Emulsion (Z). Emulsion (Z) was confirmed, by observation with an electron microscope, to have conjugated particles which were of nearly the same shape as the particles in Emulsion (K) described above (FIG. 20).

EXAMPLE 5

In the preparation of Emulsion (E) in Example 1, 1-(m-methylureidophenyl)-5-mercaptotetrazole was added in the stage where 25%, on the basis of the silver amount, of the host crystals were formed to obtain Emulsion (E-1); similarly, the tetrazole compound was added in the stage where 60%, on the basis of the silver amount, of the host crystals were formed to obtain Emulsion (E-2); again, the tetrazole compound was added in the stage where 36% of the silver nitrate used to form the second crystals was consumed to obtain Emulsion (E-3); and finally the tetrazole compound was added in the stage where 71%, on the basis of the silver amount, of the second crystals were formed to obtain Emulsion (E-4). Each emulsion thus obtained was observed with an electron microscope, which indicated that the host crystals themselves had the same crystal shape as that of the crystals of Emulsion (I) described above, having no (100) surfaces, and, therefore, no conjugated particles within the scope of the present invention were formed in Emulsion (E-1); Emulsion (E-2) contained the conjugated particles of the present invention formed therein; Emulsion (E-3) also contained the conjugated particles of the present invention formed therein; and Emulsion (E-4) contained conjugated particles formed therein, but the particles had no definite (110) surfaces.

EXAMPLE 6

In the preparation of Emulsion (P) in Example 2, 4-hydroxy-6-methyl-1,3,3a,7-tetraazaindene was not added over the same time period, but was added concurrently with the halide solution to form the second silver halide crystals over the course of the same period of time and at a constant flow rate for the addition, to obtain Emulsion (P-1). Emulsion (P-1) was observed to contain particles having nearly the same shape as that of the particles in Emulsion (E) described above.

EXAMPLE 7

Figure 21:
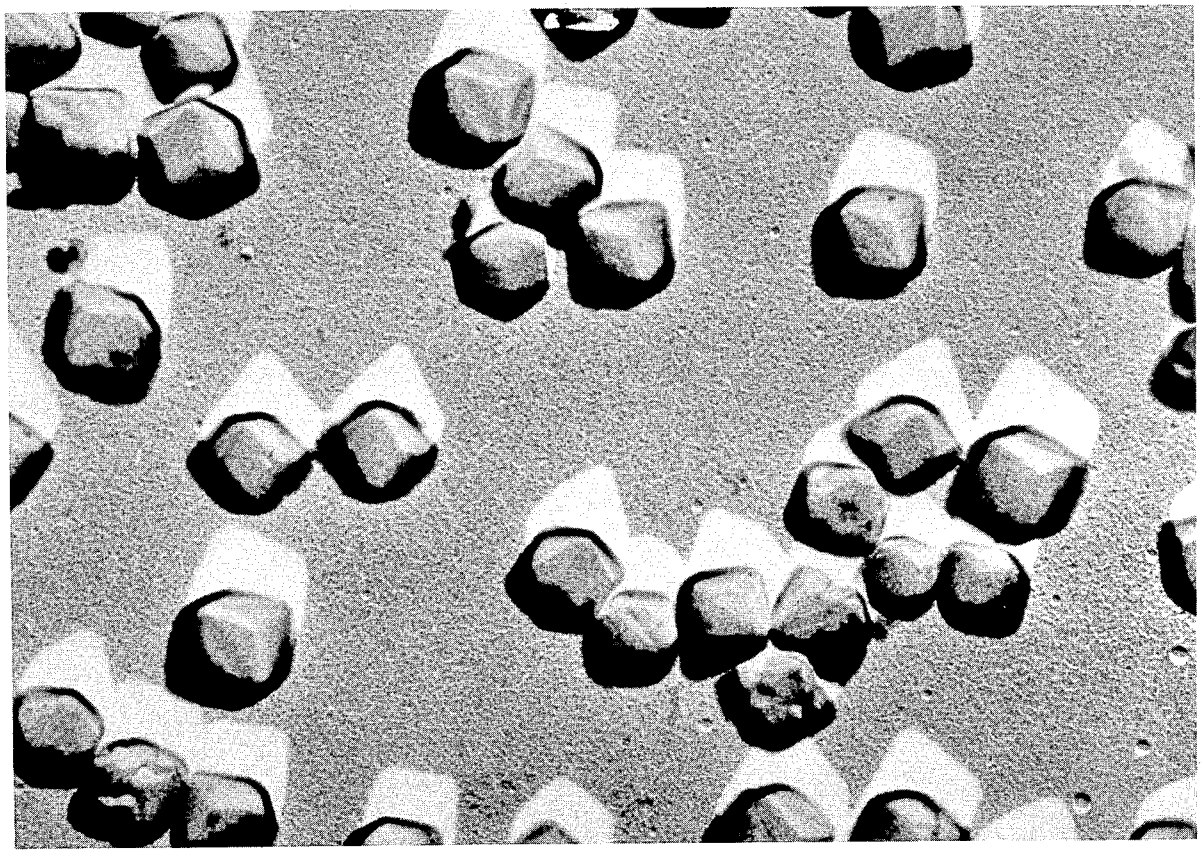

30 g of lime-treated gelatin was added to 1,000 cc of distilled water and dissolved at 40° C., and then 6.5 g of sodium chloride was added thereto and dissolved, and the temperature of the resulting solution was elevated up to 52.5° C. A solution containing 6.25 g of silver nitrate dissolved in 750 cc of distilled water and a solution containing 21.5 g of potassium chloride dissolved in 500 cc of distilled water were added to the previous solution over the course of 40 minutes, while the temperature was kept at 52.5° C., and blended. To the emulsion containing the thus-formed host crystals was added 4-hydroxy-6-methyl-1,3,3a,7-tetraazaindene, and then a solution containing 62.5 g of silver nitrate dissolved in 500 cc of distilled water and a solution containing 43.8 g of potassium bromide dissolved in 300 cc of distilled water were further added thereto over the course of 10 minutes, while the temperature was kept at 77.5° C., and blended. The crystal particles formed in this emulsion, labeled Emulsion (B-1), were confirmed, by observation with an electron microscope, to have almost the same conjugated crystal shapes as those in Emulsion (P) described above (FIG. 21).

Figure 22:
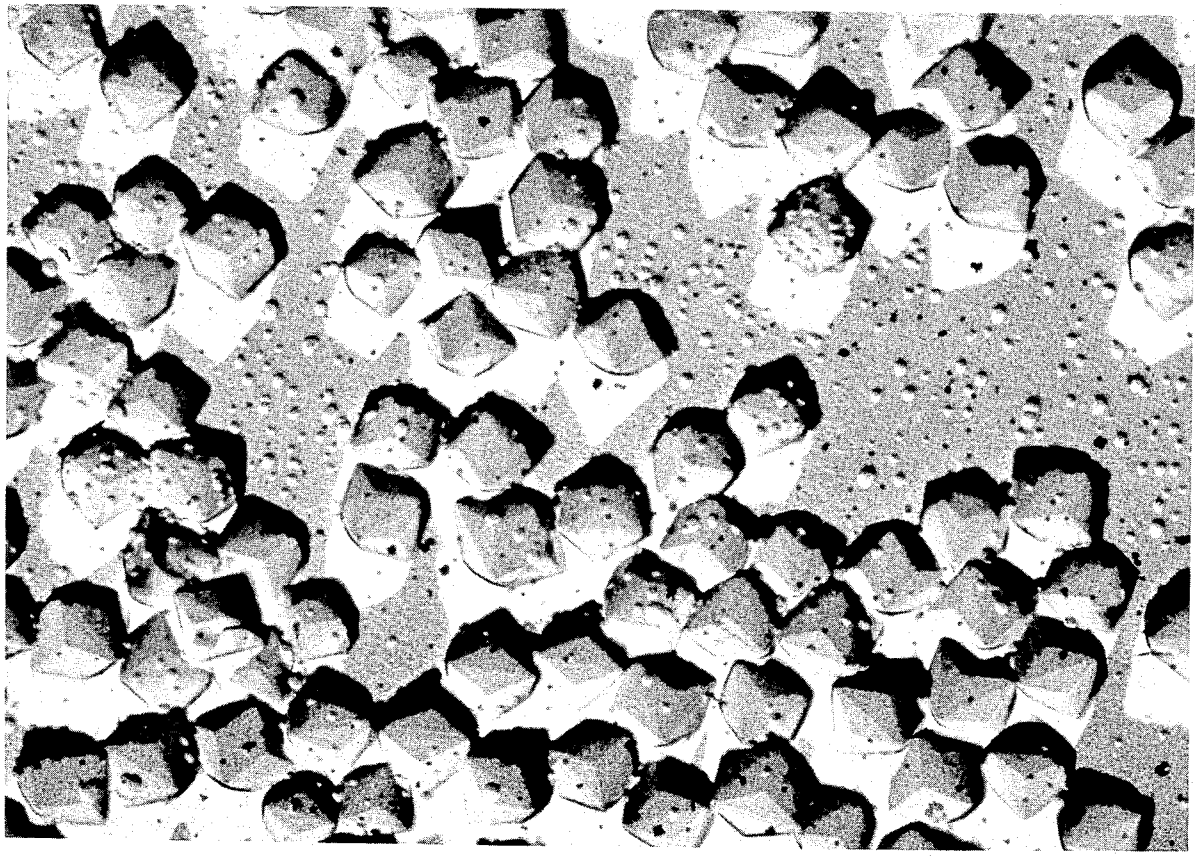

30 g of lime-treated gelatin was added to 1,000 cc of distilled water and dissolved at 40° C., and then 6.5 g of sodium chloride and 0.02 g of N,N'-dimethylethylenethiourea were added thereto and dissolved. Afterwards, the temperature of the resulting solution was elevated up to 77.5° C. Next, a solution containing 62.5 g of silver nitrate dissolved in 750 cc of distilled water and a solution containing 43.8 g of potassium bromide dissolved in 500 cc of distilled water were added to the previous solution over the course of 40 minutes, while the temperature was kept at 77.5° C., and blended. To this emulsion containing the host crystals was added 4-hydroxy-6-methyl-1,3,3a,7-tetraazaindene, and then a solution containing 62.5 g of silver nitrate dissolved in 500 cc of distilled water and a solution containing 21.5 g of potassium chloride dissolved in 300 cc of distilled water were further added thereto over the course of 10 minutes, while the temperature was kept at 52.5° C., and blended. The crystal particles formed in this emulsion, labeled Emulsion (B-2), were confirmed, by observation with an electron microscope, to have almost the same conjugated crystal structure as those in Emulsion (P) described above (FIG. 22).

The amount of 4-hydroxy-6-methyl-1,3,3a,7-tetraazaindene as used in the preparation of these two emulsions was 0.6 g in each case.

EXAMPLE 8

30 g of lime-treated gelatin was added to 1,000 cc of distilled water and dissolved at 40° C., and then the pH value of the resulting solution was regulated to 4.0 with sulfuric acid, 6.5 g of sodium chloride was added thereto and dissolved, and the temperture of the resulting solution was elevated up to 57.5° C. Next, a solution containing 62.5 g of silver nitrte dissolved in 750 cc of distilled water and a solution containing 4.4 g of potassium bromide and 19.4 g of sodium chloride dissolved in 500 cc of distilled water were added to the previous solution over the course of 40 minutes, while the temperature was kept at 57.5° C., and blended. To this emulsion containing the host crystals was added 0.16 g of 1-(m-methylureidophenyl)-5-mercaptotetrazole, and then a solution containing 62.5 g of silver nitrate dissolved in 500 cc of distilled water and a solution containing 21.5 g of potassium chloride dissolved in 300 cc of distilled water were further added thereto over the course of 10 minutes, while the temperature was kept at 52.5° C., and blended. The crystal particles thus formed were conjugated particles having almost the same shape as that of the particles in Emulsion (D) described above.

EXAMPLE 9

30 g of lime-treated gelatin was added to 1,000 cc of distilled water and dissolved at 40° C., and then 6.5 g of sodium chloride and 0.02 g of N,N'-dimethylethylenethiourea were added thereto and dissolved, and the temperature of the resulting solution was elevated up to 72.5° C. Next, a solution containing 62.5 g of silver nitrate dissolved in 750 cc of distilled water and a solution containing 35.0 g of potassium bromide and 4.3 g of sodium chloride dissolved in 500 cc of distilled water were added thereto over the course of 40 minutes, while the temperature was kept at 72.5° C., and blended. To the emulsion containing these host crystals was added 0.16 g of 1-(m-methylureidophenyl)-5-mercaptotetrazole, and, further, a solution containing 62.5 g of silver nitrate dissolved in 500 cc of distilled water and a solution containing 26.3 g of potassium bromide and 8.6 g of potassium chloride dissolved in 300 cc of distilled water were added thereto over the course of 10 minutes, while the temperature was kept at 67.5° C., and blended. The crystal particles formed were conjugated particles having almost the same shape as those of the particles in Emulsion (E) described above.

EXAMPLE 10

Comparative Emulsion (B) and Emulsions (D) and (P) of the present invention were demineralized and washed with water and then chemically sensitized with 6 mg of sodium thiosulfate for 40 minutes at 60° C. Each emulsion was then coated on a paper support, after gelatin had been added thereto, the amount of the coated silver being 0.6 g/m$^2$, to obtain Samples (b), (d), (p), respectively. These samples were exposed to a white light of 2,800° K. through a continuous wedge for 1/10 second, and then developed with the following black-and-white developer at 20° C. for 3 minutes. The photographic density obtained was measured in each sample, and the results are in Table 2 below.

| Developer: | |
|---|---|
| Ascorbic Acid | 10 g |
| (p-Methyl)aminophenol | 2.4 g |
| Sodium Carbonate | 10 g |
| Potassium Bromide | 1 g |
| Water to make | 1 liter |

TABLE 2

| Sample | Sensitivity | Fog | Remarks |
|---|---|---|---|
| (b) | 100 | 0.03 | Comparison |
| (d) | 180 | 0.03 | Invention |
| (p) | 195 | 0.03 | Invention |

A relative sensitivity was used for the evaluation of the sensitivity of the samples, whereupon the reciprocal of the exposure required for obtaining a density value of (fog +0.2) in Sample (b) was 100. Table 2 demonstrates the high sensitivity of the emulsions of the present invention.

EXAMPLE 11

The layers shown in Table 3 below were provided on a paper support, both surfaces of which had been laminated with polyethylene, to form a multilayered color print. The coating solutions were prepared as follows:

Preparation of the Coating Solution for the First Layer 27.2 ml of ethyl acetate and 7.9 ml of the solvent (c) were added to 19.1 g of the yellow coupler (a) and 4.4 g of teh color image stabilizer (b) and dissolved, and the resulting solution was emulsified and dispersed in 185 ml of a 10% gelatin aqueous solution containing 8 ml of 10% sodium dodecylbenzenesulfonate. Additionally, the blue-sensitive sensitizing dye shown below was added to the silver chlorobromide emulsion (silver bromide: 4.0 mol%, Ag content: 70 g/kg) in an amount of $5.0\times10^{-4}$ mol per mol of silver. The emulsified dispersion and the silver chlorobromide emulsion were blended and dissolved to obtain the coating solution for the first layer, the gelatin concentration being adjusted as shown in Table 3 below.

Preparation of Coating Solutions for the Second to Seventh Layers

In the same manner as in the preparation of the coating solution for the first layer described above, coating solutions for the second to the seventh layers were prepared. The gelatin hardener used in each layer was sodium 1-oxy-3,5-dichloro-s-triazine.

The spectral sensitizer used in each emulsion was as follows.

Blue-Sensitive Emulsion Layer:

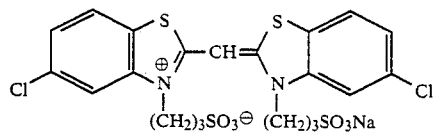

(added amount: $5.0\times10^{-4}$ mol per mol of silver halide)

Green-Sensitive Emulsion Layer:

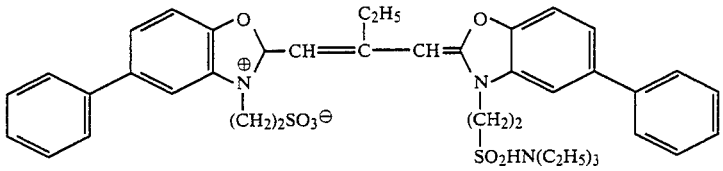

(added amount: $4.0\times10^{-4}$ mol per mol of silver halide)

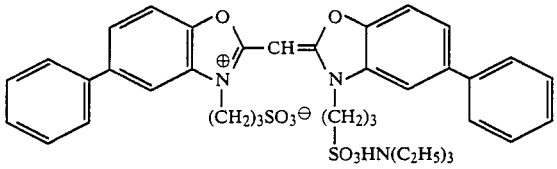

(added amount: $7.0\times10^{-5}$ mol per mol of silver halide)

Red-Sensitive Emulsion Layer:

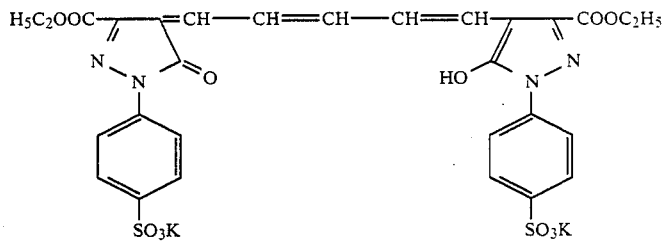

Red-Sensitive Emulsion Layer:

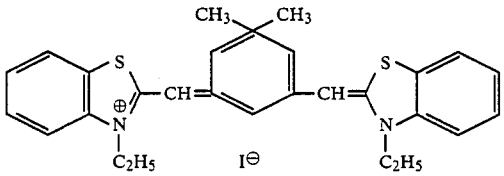

(added amount: $1.0\times10^{-4}$ mol per mol of silver halide)

The anti-irradiation dye used in each emulsion layer was as follows:

Green-Sensitive Emulsion Layer:

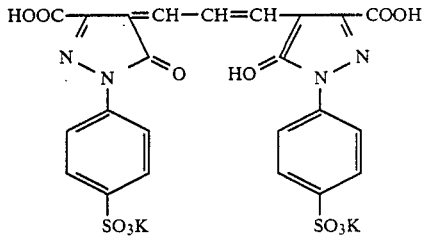

The other compounds (including couplers) used in various layers as shown in Table 3 in the amounts shown therein were as follows:

(a) Yellow Coupler:

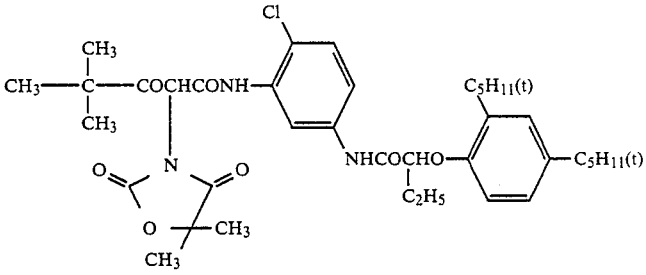

(b) Color Image Stabilizer:

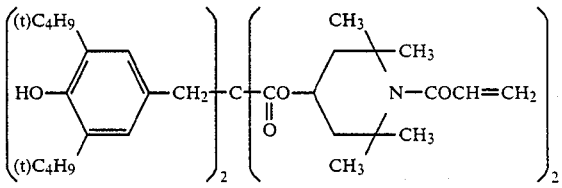

(c) Solvent:

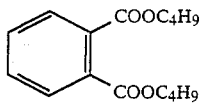

(d) Color Stain Inhibitor:

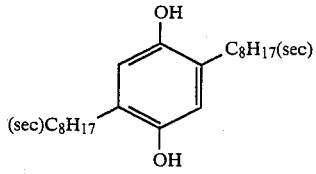

(h) Ultraviolet Absorbent:
Mixture (1:5:3 by molar ratio) of the following compounds (1), (2) and (3), respectively:

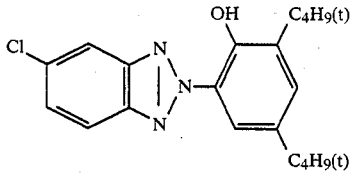

(1)

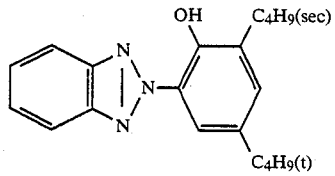

(2)

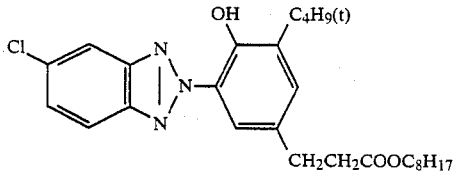

(3)

(i) Color Stain Inhibitor:

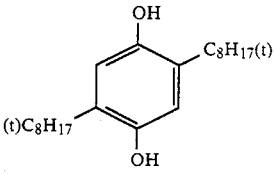

(j) Solvent:
(iso $C_9H_{18}O)_3$ P=O
(e) Magenta Coupler:

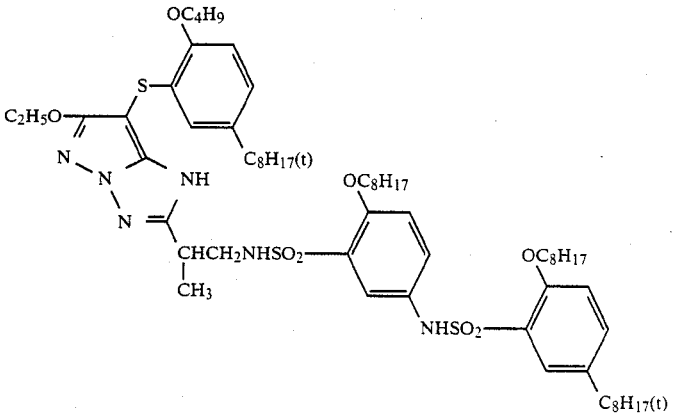

(f) Color Image Stabilizer:

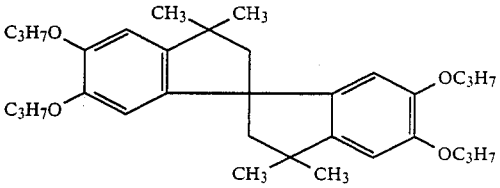

(g) Solvent:
Mixture (2:1 by weight ratio) of the following Compounds (1) and (2):

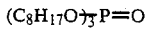

(1)

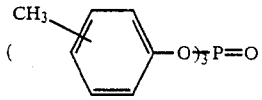

(2)

(k) Cyan Coupler:

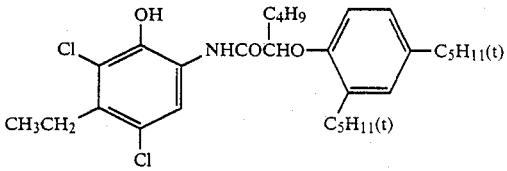

(l) Color Image Stabilizer:
Mixture (1:3:3 by moiar ratio) of the following compounds (1), (2) and (3), respectively:

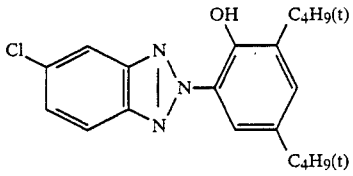

(1)

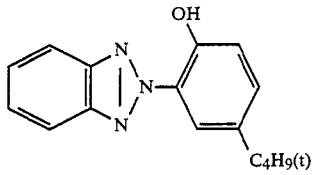

(2)

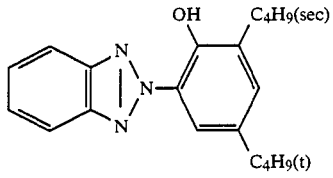

(3)

TABLE 3

| | |
|---|---|
| **Seventh Layer: Protective Layer** | |
| Gelatin | 1.33 g/m$^2$ |
| Acryl-modified polyvinyl alcohol copolymer (modification degree: 17%) | 0.17 g/m$^2$ |
| **Sixth Layer: Ultraviolet Absorbent Layer** | |
| Gelatin | 0.54 g/m$^2$ |
| Ultraviolet absorbent (h) | 0.21 g/m$^2$ |
| Solvent (j) | 0.09 cc/m$^2$ |
| **Fifth Layer: Red-Sensitive Layer** | |
| Silver chlorobromide (silver bromide: 3.0 mol %) | 0.26 g (Ag)/m$^2$ |
| Gelatin | 0.98 g/m$^2$ |
| Cyan coupler (k) | 0.38 g/m$^2$ |
| Color image stabilizer (l) | 0.17 g/m$^2$ |
| Solvent (c) | 0.23 cc/m$^2$ |
| **Fourth Layer: Ultraviolet Absorbent Layer** | |
| Gelatin | 1.60 g/m$^2$ |
| Ultraviolet absorbent (h) | 0.62 g/m$^2$ |
| Color stain inhibitor (i) | 0.05 g/m$^2$ |
| Solvent (j) | 0.26 cc/m$^2$ |
| **Third Layer: Green-Sensitive Layer** | |
| Silver chlorobromide emulsion (chemically sensitized Emulsion (B), (D) or (P) in Example 1) | 0.16 g (Ag)/m$^2$ |
| Gelatin | 1.80 g/m$^2$ |
| Magenta coupler (e) | 0.45 g/m$^2$ |
| Color image stabilizer (f) | 0.20 g/m$^2$ |
| Solvent (g) | 0.45 cc/m$^2$ |
| **Second Layer: Color Stain Inhibitory Layer** | |
| Gelatin | 0.99 g/m$^2$ |
| Color stain inhibitor (d) | 0.08 g/m$^2$ |
| **First Layer: Blue-Sensitive Layer** | |
| Silver chlorobromide emulsion (silver bromide: 4.0 mol %) | 0.27 g (Ag)/m$^2$ |
| Gelatin | 1.86 g/m$^2$ |
| Yellow coupler (a) | 0.74 g/m$^2$ |
| Color image stabilizer (b) | 0.17 g/m$^2$ |
| Solvent (c) | 0.31 cc/m$^2$ |
| **Support:** | |
| Polyethylene-laminated paper (containing white pigment ($TiO_2$) and bluish dye (ultramarine) in the polyethylene in the same side of the support as the first layer | |

The chemically sensitized Emulsions (B), (D) and (P) were used as the silver chlorobromide emulsions in the green-sensitive layer of the material described above in Table 3 to obtain Color Print Samples (I), (II) and (III), respectively.

The color print samples thus obtained were exposed by wedge exposure and then processed in accordance with the following procedure:

| Processing Step | Time | Temperature (°C.) |
|---|---|---|
| Color Development | 45 sec | 35 |
| Bleaching-Fixation | 45 sec | 35 |
| Rinsing (with four-tank cascade) | 1 min 30 sec | 30 |
| Drying | 50 sec | 80 |

The composition of the treating solution used in each of the above processing steps was as follows:

| | |
|---|---|
| **Color Developer:** | |
| Water | 800 ml |
| Diethylenetriaminepentaacetic Acid | 1.0 g |
| Sodium Sulfite | 0.2 g |
| Potassium Bromide | 0.02 g |
| Sodium Chloride | 1.5 g |
| Potassium Carbonate | 30 g |
| N—Ethyl-N—(β-methanesulfonamidoethyl)-3-methyl-4-aminoaniline Sulfate | 4.5 g |
| N,N—Diethylhydroxylamine | 4.2 g |
| 4,4'-Diaminostilbene Type Brightening Agent (Whitex 4, by Sumitomo Chemical Co., Ltd.) | 1.0 g |
| Water to make | 1,000 ml |
| KOH to adjust pH to 10.25 | |
| **Bleaching-Fixation Solution:** | |
| Water | 400 ml |
| Ammonium Thiosulfate (70%) | 150 ml |
| Sodium Sulfite | 18 g |
| Ammonium Ethylenediaminetetraacetato Ferrate | 55 g |
| Ethylenediaminetetraacetic Acid | 5 g |
| Water to make | 1,000 ml |
| pH | 6.75 |
| **Rinsing Solution:** | |
| 1-Hydroxyethylidene-1,1-diphosphonic Acid (60%) | 1.5 ml |
| Nitrilotriacetic Acid | 1.0 g |
| Nitrilo-N,N,N—trimethylenephosphonic Acid | 1.0 g |
| Ethylenediaminetetraacetic Acid | 0.5 g |
| Ethylenediamine-N,N,N',N'—tetramethylene-phosphonic Acid | 1.0 g |
| Bismuth Chloride (40%) | 0.5 g |
| Magnesium Sulfate | 0.2 g |
| Zinc Sulfate | 0.3 g |
| Ammonium Alum | 0.5 g |
| 5-Chloro-2-methyl-4-isothiazolin-3-one | 30 mg |
| 2-Methyl-4-isothiazolin-3-one | 10 mg |
| 2-Octyl-4-isothiazolin-3-one | 10 mg |
| Ethylene Glycol | 1.5 g |
| Sulfanylamide | 0.1 g |
| 1,2,3-Benzotriazole | 1.0 g |
| Ammonium Sulfite (40%) | 1.0 g |
| Aqueous Ammonia (26%) | 2.6 ml |
| Polyvinyl Pyrrolidone | 1.0 g |
| Brightening Agent (4,4'-diamino-stilbene type) | 1.0 g |
| Water to make | 1,000 ml |
| KOH to adjust pH to 7.0 | |

The results obtained are shown in Table 4 below:

TABLE 4

| Sample | Sensitivity | Fog | Remarks |
|---|---|---|---|
| (I) | 100 | 0.09 | Comparison |
| (II) | 162 | 0.08 | Invention |
| (III) | 182 | 0.08 | Invention |

A relative sensitivity was used for the evaluation of the sensitivity of the samples, whereupon the reciprocal of the exposure required for obtaining a density value of (fog +0.5) in Sample (I) was 100. Table 4 above demonstrates high sensitivity and low amount of fog formation in the emulsions of the present invention.

The above examples illustrate that the silver halide photographic emulsions of the present invention have high sensitivity with low amount of fog formation.

While the invention has been described in detail and with reference to specific embodiments thereof, it will be apparent to one skilled in the art that various changes and modifications can be made therein without departing from the spirit and scope thereof.

What is claimed is:

1. A silver chlorobromide emulsion which is substantially free from silver iodide and which contains silver halide crystal particles comprising cubic, rectangular parallelepiped or tetradecahedral first silver halide crystals having six (100) surfaces, at least one of said six (100) surfaces projection conjugated with second silver halide crystals having a halogen composition different from that of said (100) surfaces of said first silver halide crystals and mainly comprising (110) crystal surfaces.

2. A silver chlorobromide emulsion as claimed in claim 1, wherein the emulsion contains about 90% or more of the conjugated particles where the second silver halide crystals are conjugated to at least one of six (100) surfaces of said first silver halide crystals as calculated on the basis of the total number or weight of particles in the emulsion.

3. A silver chlorobromide emulsion as claimed in claim 1, wherein the emulsion contains about 85% or more of the conjugated particles where the second silver halide crystals are conjugated to at least three of six (100) surfaces of said first silver halide crystals as calculated on the basis of the total number or weight of particles in the emulsion.

4. A silver chlorobromide emulsion as claimed in claim 1, wherein the emulsion contains about 60% or more of the conjugated particles where the second silver halide crystals are conjugated to at least four of six (100) surfaces of said first silver halide crystals as calculated on the basis of the total number or weight of particles in the emulsion.

5. A silver chlorobromide emulsion as claimed in claim 1, wherein said second silver halide crystals are conjugated on all of the (100) surfaces of said first silver halide crystals.

6. A silver chlorobromide emulsion as claimed in claim 1, wherein the ratio of the silver halide constituting said first silver halide crystals to the silver halide constituting said second silver halide crystals is about 0.1 mol/mol to about 6 mols/mol.

7. A silver chlorobromide emulsion as claimed in claim 1, wherein the ratio of conjugated particles having said second silver halide crystals formed on all (100) surfaces of said first silver halide crystals to the total conjugated crystals is about 40% or more, based on the total number of conjugated crystals in the emulsion or the weight of said conjugated crystals in the emulsion.

8. A method for the preparation of a conjugated silver chlorobromide particle-containing emulsion which is substantially free from silver iodide which comprises forming cubic, rectangular parallelepiped or tetradecahedral first silver halide crystals having six (100) surfaces and then adding thereto an aqueous halide solution and an aqueous silver salt solution in the presence of a crystal habit regulator, wherein at least one of said six (100) surfaces of said first silver halide crystals is projection conjugated with second silver halide crystals mainly comprising (110) crystal surfaces and having a halogen composition different from that of said (100) surfaces of said first silver halide crystals.

9. A method for the preparation of a conjugated silver chlorobromide particle-containing emulsion as claimed in claim 5, wherein said crystal habit regulator is added to the reaction system prior to the formation of about 70 mol% of the conjugated crystals.

10. A method for the preparation of a conjugated silver chlorobromide particle-containing emulsion as claimed in claim 6, wherein said crystal habit regulator is added to the reaction system prior to the formation of about 40 mol% of the conjugated crystals.

11. A method for the preparation of a conjugated silver chlorobromide particle-containing emulsion as claimed in claim 5, wherein said crystal habit regulator is a mercaptotetrazole type compound, a mercaptotriazole type compound a mercaptothiadiazole type compound, a hydroxyazaindene,, a merocyanine dye having a rhodanine nucleus or a thiohydantoin nucleus, or a cyanine dye.

12. A method for the preparation of a conjugated silver chlorobromide particle-containing emulsion as claimed in claim 5, wherein said aqueous halide solution and said aqueous silver salt solution are added at a speed within the range of from about 0.1 to about 5 times the critical growth speed of the conjugated particles.

13. A silver chlorobromide emulsion as claimed in claim 1, wherein said silver halide emulsion is a monodispersed emulsion.

14. A silver chlorobromide emulsion as claimed in claim 10, wherein a variation coefficient of said monodispersed emulsion is not more than about 0.20.

15. A silver chlorobromide emulsion as claimed in claim 10, wherein a variation coefficient of said monodispersed emulsion is not more than about 0.15.

16. A silver chlorobromide emulsion as claimed in claim 1, wherein said halogen composition of the first silver halide crystals to be conjugated on the host crystals is a silver bromide, a silver chlorobromide or a silver chloride.

17. A method for the preparation of a conjugated silver chlorobromide particle-containing emulsion as claimed in claim 1, wherein said halogen composition of the second silver halide crystals to be conjugated on the host crystals is a silver chlorobromide or a silver chloride.

18. A method for the preparation of a conjugated silver chlorobromide particle-containing emulsion as claimed in claim 9, wherein said range is from about 0.15 to about 3 times.

19. A method for the preparation of a conjugated silver chlorobromide particle-containing emulsion as claimed in claim 9, wherein the crystal habit regulator is a mercaptotetrazole type compound, a mercaptotriazole type compound, a mercaptothiadiazole type compound, a hydroxyazaindene, a merocyanine dye having a rhodanine nucleus or a thiohydantoin nucleus, or a cyanine dye.

20. A method for the preparation of a conjugated silver chlorobromide particle-containing emulsion as claimed in claim 17, wherein the amount of said mercaptotetrazole type compound or a mercaptothiadiazole type compound is from about $2\times10^{-5}$ to $2\times10^{-2}$ mol, the amount of said hydroxyazaindene is from about $2\times10^{-4}$ to $2\times10^{-1}$ mol, and the amount of said merocyanine dye or a cyanine dye is from about $2\times10^{-5}$ to $2\times10^{-2}$ mol, per mol of the Ag ion used for the formation of the conjugated crystals.

21. A method for the preparation of a conjugated silver chlorobromide particle-containing emulsion as claimed in claim 17, wherein said mercaptotetrazole type compound is selected from those represented by the general formula (I):

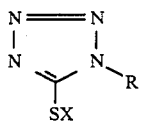

(I)

wherein R represents an alkyl group, an alkenyl group or an aryl group, and X represents a hydrogen atom, an alkali metal atom, an ammonium group or a precursor; said mercaptothiadiazole type compound is selected from those represented by the general formula (II):

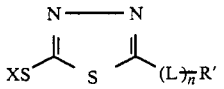

(II)

wherein L represents a divalent linking group, R′ represents a hydrogen atom, an alkyl group, an alkenyl group or an aryl group, X represents the same meaning as defined in the general formula (II), and n represents 0 or 1;

and said hydroxyazaindene is selected from those represented by the general formula (III):

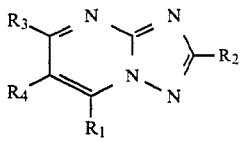

(III)

wherein $R_1$, $R_2$, $R_3$ and $R_4$, which may be the same or different, each represents a hydrogen atom in which the number of hydroxyl group in the formula is to be 1 or 2, an alkyl group, an alkenyl group, an aryl group, a cyano group, a ureido group, an amino group, a halogen atom or a hydrogen atom.

22. A silver chlorobromide emulsion as claimed in claim 1, wherein said first silver halide crystals further comprise additional (110) surfaces.

23. A method for the preparation of a conjugated silver chlorobromide particle-containing emulsion as claimed in claim 8, wherein said first silver halide crystals further comprise additional (110) surfaces.

* * * * *